US009062940B2

(12) United States Patent
Firth

(10) Patent No.: US 9,062,940 B2
(45) Date of Patent: Jun. 23, 2015

(54) MINE DETONATING APPARATUS

(71) Applicant: Charles Basil Firth, Kilmarnock (GB)

(72) Inventor: Charles Basil Firth, Kilmarnock (GB)

( * ) Notice: Subject to any disclaimer, the term of this patent is extended or adjusted under 35 U.S.C. 154(b) by 0 days.

(21) Appl. No.: 14/181,209

(22) Filed: Feb. 14, 2014

(65) Prior Publication Data

US 2014/0157975 A1 Jun. 12, 2014

Related U.S. Application Data

(63) Continuation-in-part of application No. 12/482,969, filed on Jun. 11, 2009, now abandoned.

(30) Foreign Application Priority Data

Jun. 11, 2008 (GB) ..... 0810643.7

(51) Int. Cl.
*F41H 11/16* (2011.01)
*F41H 11/30* (2011.01)

(52) U.S. Cl.
CPC ..... *F41H 11/30* (2013.01)

(58) Field of Classification Search
CPC ..... F41H 11/12; F41H 11/16; F41H 11/30
USPC ..... 89/1.13; 102/402; 280/419, 481
See application file for complete search history.

(56) References Cited

U.S. PATENT DOCUMENTS

| | | | | |
|---|---|---|---|---|
| 2,099,902 | A | 11/1937 | Moyer et al. | |
| 2,100,447 | A | 11/1937 | Mahaffey | |
| 2,533,553 | A | 12/1950 | Burns | |
| 3,740,874 | A | 6/1973 | Boschung | |
| 3,783,963 | A | 1/1974 | Erwin | |
| 3,834,480 | A | 9/1974 | McGee | |
| 4,208,063 | A | 6/1980 | Baker et al. | |
| 4,399,884 | A | 8/1983 | Vandehey | |
| 4,478,026 | A | 10/1984 | Mullet et al. | |
| 4,765,221 | A * | 8/1988 | Sombrowski | 89/1.13 |
| 5,189,243 | A * | 2/1993 | Hambric | 89/1.13 |
| 6,129,170 | A | 10/2000 | Hickman et al. | |
| 6,135,484 | A | 10/2000 | Lauronen et al. | |
| 6,581,718 | B1 | 6/2003 | Vigren et al. | |
| 6,915,728 | B2 | 7/2005 | Renwick et al. | |
| 8,109,531 | B2 | 2/2012 | Priepke et al. | |
| 2003/0145716 | A1 * | 8/2003 | Dixon | 89/1.13 |
| 2004/0035285 | A1 | 2/2004 | Renwick et al. | |

(Continued)

FOREIGN PATENT DOCUMENTS

| | | | | |
|---|---|---|---|---|
| CA | 2234597 | A1 * | 10/1999 | F41G 11/16 |
| CA | 2660621 | A1 | 8/2009 | |

(Continued)

*Primary Examiner* — Bret Hayes
(74) *Attorney, Agent, or Firm* — Kinney & Lange, P.A.

(57) ABSTRACT

A steerable mine detonation apparatus is adapted to be pushed by a steered vehicle. The apparatus comprises a frame and at least two spaced apart ground engaging members adapted to support the apparatus and adapted to exert a force on mines in the apparatus' path sufficient to cause detonation thereof. At least one ground engaging member is steerable, and at least one steerable ground engaging member is attached to the frame so as to pivot with respect thereto about a substantially vertical axis and is connected to a steering linkage, the apparatus further comprising a steering mechanism operatively connected to the steering linkage and, in use, to the pushing vehicle. An actuator is adapted to vary the configuration of the steering mechanism.

25 Claims, 35 Drawing Sheets

(56) References Cited

U.S. PATENT DOCUMENTS

| | | | | |
|---|---|---|---|---|
| 2007/0272074 | A1* | 11/2007 | Kim | 89/1.13 |
| 2008/0223591 | A1* | 9/2008 | Priepke et al. | 172/279 |
| 2011/0296976 | A1* | 12/2011 | Simula et al. | 89/1.13 |
| 2013/0327203 | A1* | 12/2013 | Cronk | 89/1.13 |

FOREIGN PATENT DOCUMENTS

| | | | |
|---|---|---|---|
| EP | 0350008 | A2 | 1/1990 |
| JP | 11211397 | A1 | 8/1999 |
| WO | 2004050457 | A1 | 6/2004 |
| WO | 2009038762 | A1 | 3/2009 |

* cited by examiner

MINE DETONATING APPARATUS

CROSS-REFERENCE TO RELATED APPLICATION(S)

This application is a continuation-in-part of U.S. application Ser. No. 12/482,969 filed Jun. 11, 2009 for "Mine Detonating Apparatus" by Charles Basil Firth, which in turn claims priority to Great Britain Application No. 0810643.7 filed Jun. 11, 2008. U.S. application Ser. No. 12/482,969 is hereby incorporated by reference in its entirety.

FIELD OF THE INVENTION

The present invention relates to mine detonating apparatus. The invention relates particularly, but not exclusively, to mine detonating apparatus for use with vehicles that are fitted with wheels that are steered.

BACKGROUND OF THE INVENTION

In regions of conflict it is often necessary for wheeled vehicles to use roads, tracks and other terrain that may have been mined or laid with other improvised explosive devices (IEDs).

Mines and IEDs can be fitted with a variety of different types of fuses however they are often fitted with fuses that are designed to detonate as a result of the wheel of the vehicle passing over them, such IEDs possibly including both pressure and time delay fuses. In the remainder of this document the terms mine and IED are used interchangeably and collectively, i.e. an IED may be a mine and a mine may be an IED.

By detonating as a result of the wheel passing over them, mines explode so as to inflict the maximum damage to the vehicle, wheel and the associated steering mechanism.

Relatively small amounts of explosive can easily disable a vehicle.

A mine clearing apparatus intended for use with armoured personnel carriers (APCs) is described in U.S. Pat. No. 6,915,728. In this invention a pair of rollers is pushed in front of the APC in front of the tracks and a further set of rollers is towed behind the APC.

The position of the rollers in front of the vehicle is adjusted to partially follow the path of the vehicle by a signal resulting from the position of a further roller set mounted behind the vehicle.

The invention disclosed here is for a mine roller system that can be attached to a host vehicle or is part of the host vehicle and is pushed ahead of the host vehicle so that the path traversed by the wheels of the host vehicle lie within the path traversed by the mine roller system as it goes round a corner as well as in a straight line.

Mine roller systems that have been designed for use with wheeled vehicles are generally characterised as follows:

They comprise a frame attached to the front of the host vehicle. The frame is fitted with a number of IED detonating wheels designed to apply a downwards force on the ground in front of the vehicle to simulate the effect of a vehicle passing over them thus activating pressure influenced and other fuses that may be used with the IEDs before the vehicle passes over them.

The IED detonating wheels are usually spring loaded to allow them to lift up over local obstacles and down into local hollows and still apply a force on the ground.

The wheels are grouped into banks that are pivotably mounted onto a frame in such a way as to allow them to caster relative to the frame. They sometimes have a steering mechanism that moves the position of the supporting frame off which the wheels are castered.

It is apparent that known equipments do not sweep the path of the vehicle very well as the host vehicle goes around a bend in the road.

It is therefore an aim of the invention to overcome or at least alleviate the problem identified above.

SUMMARY OF THE INVENTION

According to one aspect of the invention there is provided an apparatus as specified in claim 1.

The apparatus may comprise at least two spaced apart steerable ground engaging members, and preferably two spaced apart steerable ground engaging members. Two spaced apart steerable ground engaging members may be set up to tow in, which assists in the apparatus following a path.

The actuator may comprise a fluid operated ram, a fluid operated motor, an electrically operated ram, or an electrically operated motor. A fluid operated ram could be actuated hydraulically or pneumatically. In the case where a motor is used rather than a hydraulic medium, power transmission apparatus may be provided. An actuator including a motor may further include a gearbox. Preferably, an output shaft of the motor is connected to the input shaft of the gearbox.

Preferably, the steering mechanism includes a feedback system adapted to measure deviation of the apparatus from the path, generate a feedback signal and to adjust the steering linkage according to the feedback signal to return the apparatus to said path. This provides the advantage that during use, when the apparatus or the pushing vehicle is subject to forces that cause movement thereof to one side, the steering mechanism adjusts the steering linkage and hence the steering angle of the steerable ground engaging members to bring the apparatus back to the desired path, that encompassing the path that the wheels of the pushing vehicle. Such a deviation from the path could occur for example after a collision with a stone, whilst traversing a slope or if a wheel of the pushing vehicle falls into a rut. The feedback system provides that the apparatus would not run off path for more than a brief period.

The feedback signal may be generated mechanically, electronically, electrically or hydraulically.

The steering mechanism may further comprise at least one member arranged to pivot about a substantially vertical axis.

Advantageously, the steering mechanism comprises first and second members each arranged to rotate about substantially vertical axes, wherein the actuator is adapted to adjust the relative position of the first member with respect to the second.

The first and second members may be mounted to rotate about the same substantially vertical axis independently of each other.

Preferably, one of the first and second members is operatively connected to the steering linkage, and the other of the first and second members may be operatively connected to the pushing vehicle.

In one embodiment, the steering mechanism comprises a linkage, the linkage including a tie member pivotably attached at one of its ends to one of the first and second members and operatively attached to the steering system at its other end. The linkage may further include a tie member pivotably attached at one of its ends to the other of the first and second members at its other end to a pushing vehicle.

Preferably, the steering linkage includes a connector mounted on the frame and operatively connected to the or each steerable ground engaging member, and the steering mechanism. Operative connection of the connector to the steerable ground engaging members may be achieved by the use of track rods, and/or the fluid actuators. Operative connection of the connector to the steering mechanism is advantageously by means of a tie rod.

At least one ground engaging member may be adapted to follow the path of the apparatus set by the at least one steerable ground engaging member.

The apparatus may further include a steering lock providing locked and unlocked configurations of the or each steerable ground engaging members. The steering lock may include at least one element movable between a locked configuration in which said element engages with a part of the steerable ground engaging member and an unlocked configuration in which the said element is disengaged from the steerable ground engaging member.

Preferably, the actuator is provided with a neutral setting in which the actuator configuration changes according to passive forces exerted thereon. This allows the apparatus to be moved when the steerable ground engaging members are locked, for example when reversing. For example, where the actuator is hydraulic, the hydraulic circuit powering the actuator is provided with valves that permit a float setting to be selected, in which the actuator is free to extend or retract.

Alternatively, where the actuator is not suited to being provided with a neutral setting, such as the embodiment shown in FIG. 21*a*, and the feedback system comprises a mechanical link of fixed length extending between the apparatus and the pushing vehicle, then steering linkage may be controlled so as to permit reversing of the apparatus. This calls for the steerable ground engaging members 1, 2 to be steered so as to maintain them at a desired angle relative to the chassis regardless of the action of the vehicle 10. The controller may be configured to receive a signal indicating that the vehicle is reversing. Such a signal may be manually selectable, for example by depressing a switch in the cab of the pushing vehicle, or from a reversing sensor associated with the vehicle. The apparatus is advantageously provided with a sensor adapted to sense the orientation of the steerable ground engaging members relative to the frame, such as the linear transducer 155 shown in FIG. 21*a*. The output of this sensor advantageously forms and input to the controller. When the controller senses that the apparatus is reversing the controller runs an alternative algorithm, which is configured to sense the actual angle of the steerable ground engaging members relative to the frame and to issue a signal to adjust the actuator such that the angle of the steerable ground engaging members is adjusted to bring them back to the desired angle. Typically, the desired angle would be zero, that is in line with the longitudinal axis of the apparatus.

Preferably, the ground engaging members are mounted to pivot about a substantially horizontal axis.

Each steerable ground engaging member may include a plurality of individual ground engaging elements, each element preferably being mounted to move independently in a substantially vertical plane.

Another aspect of the invention provides the combination of a pushing vehicle and connect thereto a steerable mine detonation apparatus adapted to be pushed by a steered vehicle, the apparatus comprising a frame, at least two spaced apart ground engaging members adapted to support the apparatus and adapted to exert a force on mines in the path thereof sufficient to cause detonation thereof, wherein at least one ground engaging member is steerable, and wherein the at least one steerable ground engaging member is attached to the frame so as to pivot with respect thereto about a substantially vertical axis and is connected to a steering linkage, the apparatus further comprising a steering mechanism operatively connected to the steering linkage and including an actuator adapted to vary the configuration of the steering mechanism, and a control means including a controller configured to receive an input signal related to the turning radius of a pushing vehicle and to generate an actuator control signal related to the input signal, and to control the actuator according to the actuator control signal, wherein the so controlled actuator configures the steering mechanism to adjust the steering linkage such that the at least one steerable ground engaging member is positioned to follow a path which provides that, in use, the turning radius of at least a part of the innermost ground engaging member is less than the a turning radius of the innermost wheel of the pushing vehicle, and the turning radius of at least a part of the outermost ground engaging member is greater than to the a turning radius of the outermost wheel of the pushing vehicle.

As mentioned above, in clearing mines and IEDs, it is particularly important that the mine rollers should cover the path that the wheels of the pushing vehicle will traverse. The invention accomplishes this. Further, the invention provides an apparatus configured such that it returns to the required path automatically after being subjected to a force causing deviation of the apparatus from the path. Still further, the apparatus of the invention provides for the mine rollers to be spaced from the pushing vehicle by a significantly greater distance than is the case mine rollers of the prior art. This means that in the event of a mine being detonated, the risk of the pushing vehicle being damaged is much reduced, the maximum pressure of the explosion diminishes with increasing distance from source of the explosion, and hence increasing the distance between the rollers and the pushing vehicle has a marked effect on the extent of damage caused to the vehicle as a result of an explosion.

BRIEF DESCRIPTION OF THE DRAWINGS

In the Drawings, which illustrate preferred embodiments of the invention, and are by way of example only:

FIG. 7 is a plan view of the device travelling on a straight path just prior to commencing a turn to the left;

FIG. 8 is a plan view of the device illustrated in FIG. 7 with the steering wheels of the pushing vehicle turned to the left on a turning radius requiring an angle A of approximately 10 degrees to commence the turn;

FIG. 9 is a plan view of the device established on a turn with the pushing vehicle's steering wheels set on a turning radius requiring an angle A of approximately 10 degrees;

FIG. 10 is a plan view of the device moving on to a smaller turning radius with the steering wheels of the pushing vehicle turned to the left on a turning radius requiring an angle A of approximately 20 degrees;

FIG. 11 is a plan view of the device established on a turn with the pushing vehicle's steering wheels set on a turning radius requiring an angle A of approximately 20 degrees;

FIG. 12 is a plan view of the device established on a turn with the pushing vehicle's steering wheels set on a turning radius requiring an angle A of approximately 40 degrees;

FIG. 31*a* is a top plan view;

FIG. 31*b* is a side view;

FIG. 31*c* is a bottom plan view;

DETAILED DESCRIPTION OF THE PRIOR ART EMBODIMENT

Figure 1:
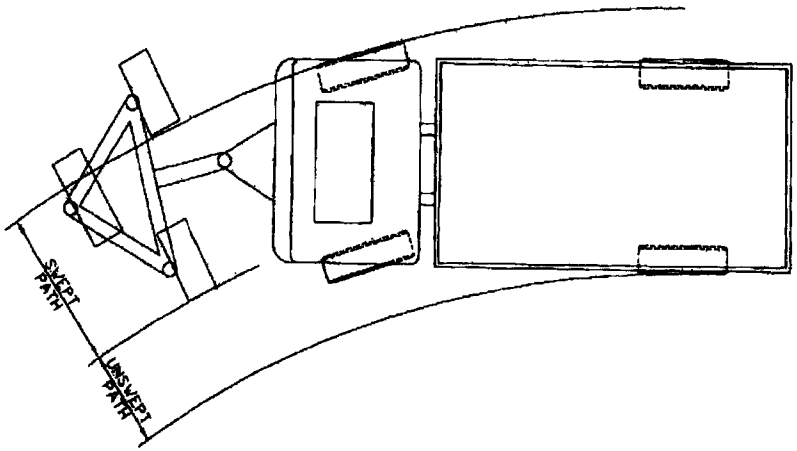
FIG 1 PRIOR ART
FIG. 1 is a plan view of a known mine clearance roller.

The sketch in FIG. 1 shows one possible arrangement of a known invention. The sketch shows the plan view of a vehicle fitted with three roller sets at its front travelling around a bend from right to left.

In FIG. 1, about one third of the path followed by the vehicle would not be swept by the rollers. This is a concern because seeing the operational capabilities of existing equipment, the enemy can simply plant their IEDs on the bends in the road and easily defeat an existing roller system.

If the framework is steered using a mechanism that reacts these forces against the host vehicle, the forces required to steer tend to induce loads much higher than intended on the front wheels and steering mechanism of the host vehicle. This is likely to result in increased wear and premature failure of the steering mechanism of the host vehicle.

It is also apparent that the spring loaded wheels that are intended to detonate mines and other IEDs are sometimes very close to the body of the host vehicle.

It is well known that the effectiveness of an explosive blast reduces with increased distance. With the detonating wheels so close to the vehicle the detonation created by them may cause substantial damage to the vehicle and puts the crew of the vehicle at increased risk.

DETAILED DESCRIPTION OF THE PREFERRED EMBODIMENTS

The present invention serves to overcome some of the limitations of existing inventions.

The mine roller system disclosed here is pushed ahead of the host vehicle its position relative to the pushing vehicle is controlled in such a way that the mine roller system automatically traverses a path that is subsequently traversed by the wheels of the host vehicle as the combination of the host vehicle and mine roller system goes round a corner as well as in a straight line. It is possible, particularly in a tight turn, that during the period between the steering wheels of the pushing vehicle being turned and the mine roller system reacting, the path taken by the wheels of the pushing vehicle may not be covered completely. This may be overcome by the provision of a manual override system to steer the mine roller system in advance of the steering wheels of the pushing vehicle for example.

The mechanism invented induces small additional loads on the steering mechanism of the host vehicle thus reducing the likelihood of excessive wear and premature failure of the host vehicle systems.

The mine rollers are pushed ahead of the host vehicle a substantial distance away from the front of the vehicle thereby reducing the risk of injury to the crew of the host vehicle and damage to the vehicle.

In the following description I describe the use of the equipment with a vehicle in the form of a four wheel drive truck. However, the fact that the truck has four wheel drive is not relevant. In fact, any steered vehicle of suitable configuration may be used.

I envisage that it will be practical to adjust the weight of the mine roller system if required depending on the vehicles with which the system is being used.

The steering mechanisms invented are shown diagrammatically in FIGS. 2 to 33*c:*

Notice the substantial "stand off" distance achieved between the wheel sets of the mine roller system and the front of the pushing vehicle. The stand off distance is the distance from the front of the pushing vehicle to the contact point with the ground of the steered ground engaging member most proximate the front of the pushing vehicle. Ideally, the stand off distance is not less than 1.5 metres.

Figure 16:
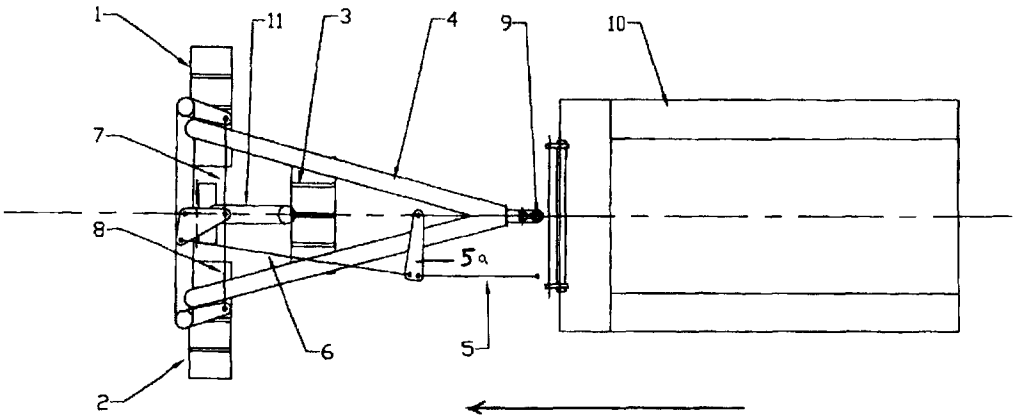
FIG. 16 is a plan view of a device according to another embodiment of the invention on a straight heading.
Figure 17:
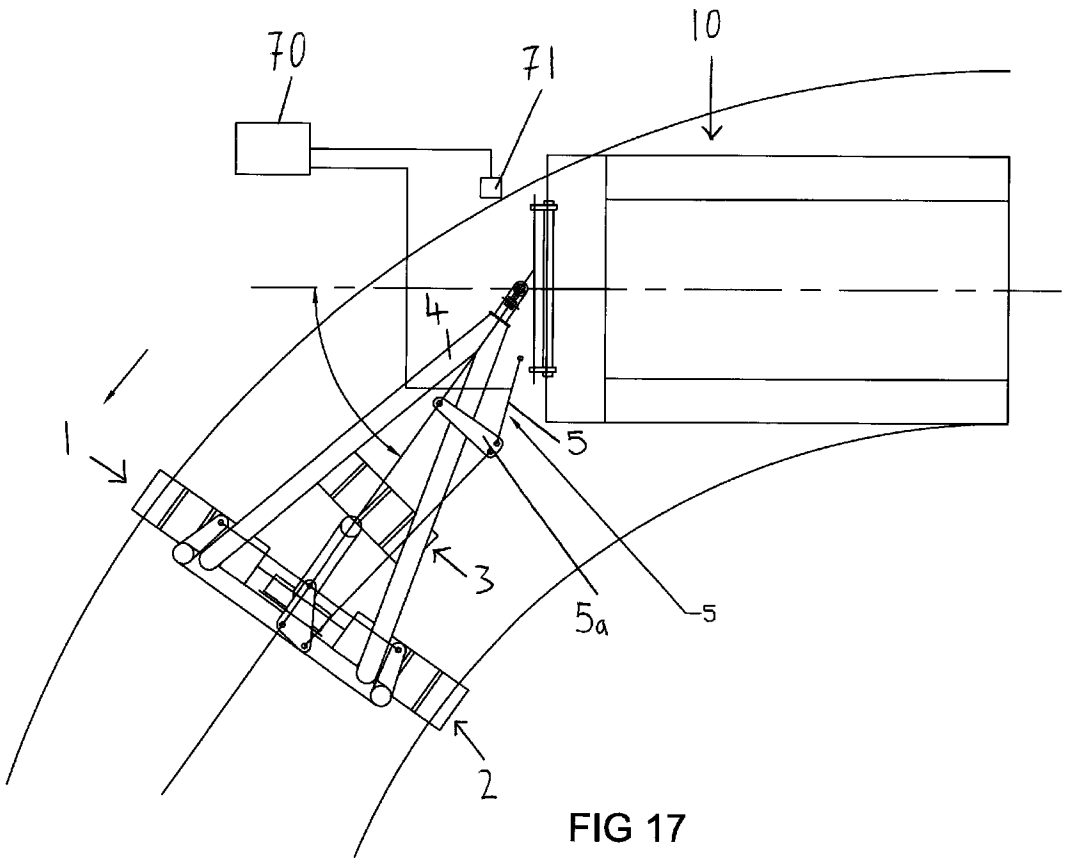
FIG. 17 is a plan view of the device illustrated in FIG. 16 executing a turn.
Figure 18:
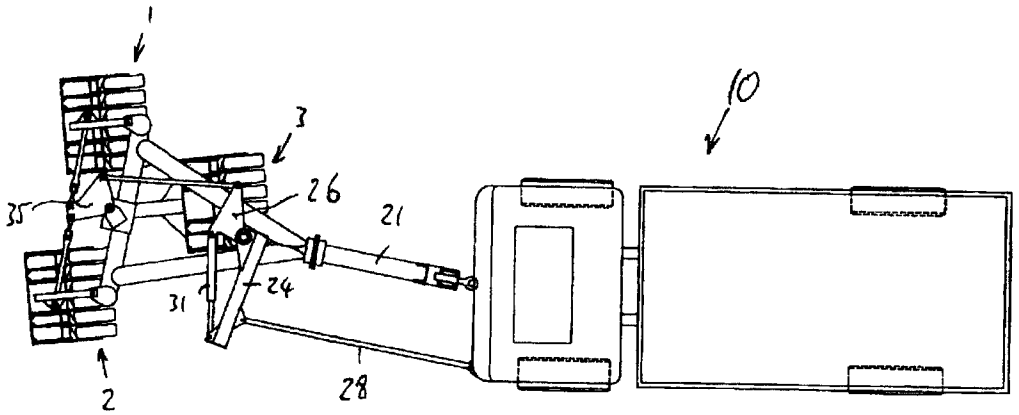
FIG. 18 is a plan view of the device following a deviation thereof from a desired path.

Referring particularly to FIGS. 16 and 17, in these drawings the wheeled host vehicle, is shown in plan view, with the mine roller system (MRS) fitted in front of it. The arrangement comprises the frame (4) connected to the vehicle (10) along the centre line. The frame can conveniently be mounted onto the NATO pintle usually found on the front of military vehicles. Mine roller sets (1), (2), and (3) are pivotally attached to the frame (4), so that they can caster about substantially vertical axes. Roller set (3) is further pivotally attached to the frame (4) by an intermediate bracket (11).

In operation, the linkage system, schematically indicated by elements (5), (6), (7) and (8) serves to automatically steer the roller sets (1) and (2) to keep them on a path in front of the vehicle. If the roller becomes out of line or the host vehicle makes minor steering adjustments, the linkage geometry is such that it will serve to maintain the roller sets (1) and (2) in front of the vehicle.

The roller set (3) is not steered, it simply follows the path taken by the roller sets (1) and (2).

FIG. 17 shows a plan view of the mine roller system pushed by the vehicle, travelling around a bend.

Note how the front roller sets are steered closely along the path that the wheels of the host vehicle follow.

This is made possible by the geometry chosen for the linkage. The angle that the frame of the mine roller system needs to take is indicated as "A" in FIG. 17. Notice how the roller sets are in line with the frame. This is made possible by adjusting the length of linkage member (5).

The required length for linkage member (5) is determined by measuring the turning circle being negotiated. This is done electronically by use of a simple linear transducer (71) or some other measuring device connected to the vehicle's steering mechanism. The measuring device may measure any parameter of the vehicle's steering mechanism from which the vehicle's turning circle may be calculated. From this electronic measurement, the programmable logic controller (70) (PLC) programme calculates the required angle "A" according to an algorithm (which is not disclosed herein, the algorithm being within the knowledge of the person skilled in the art) and the required length of linkage member (5).

When negotiating a bend of a particular turning circle, the mine rollers are automatically steered on the required path. In the same way as when the required steering angle "A" is zero i.e. when travelling in a straight line, small deviations in the direction of the apparatus or the host vehicle are compensated for by automatic tracking of the steering mechanism. If the mine rollers become out of line, the linkage automatically adjusts to compensate and steer the roller set into line.

In this embodiment the linkage member (5) is a hydraulic cylinder powered by a suitable source of pressurised hydraulic fluid such as a hydraulic power pack. The extension i.e. the position of this is accurately controlled by use of an integral linear transducer and electronic closed loop feedback system, which is electrically connected to the PLC. Signals from the PLC control valves associated with the source of pressurised hydraulic fluid to adjust the length of hydraulic cylinder (5).

The hydraulic cylinder (5) is only actuated when the turning circle of the pushing vehicle changes. At constant turning circles and in a straight line the cylinder doesn't extend or retract. The steering is automatically maintained in the correct position by the mechanism. This is important because it means that the minimum amount of power is used and the auxiliary hydraulic power pack required remains small and can be powered from the host vehicle inter-vehicle starting socket. An auxiliary hydraulic power pack typically includes an electric motor for driving a hydraulic pump. Such an electric motor may be powered directly from the host vehicle's electricity supply, for example via an inter-vehicle starting socket, or a battery pack and charger may be provided, the electric motor drawing power from the battery and the charger drawing power from the host vehicle's electricity supply. Such an arrangement allows smaller cables to be used between the host vehicle and the apparatus. Such cables may be connected to the host vehicle's inter-vehicle socket, or may be otherwise connected to the host vehicle's electricity supply.

It also means that it is not necessary to constantly correct for small steering misalignments this is achieved automatically with no hydraulic power consumption.

As the wheels of the host vehicle are steered, the turning radius that will be created is calculated from measurements received from a transducer fitted to the steering mechanism of the vehicle. The PLC is programmed to calculate the angle "A" (that is the angle of the made between the intersecting longitudinal axes of the apparatus and the host vehicle) that the frame is required to adopt to ensure that the host vehicle will follow the roller sets. The control circuitry then serves to actuate the hydraulic cylinder so as to rotate the link 5*a* relative to the frame 4. This causes the wheelsets to steer so as to bring the framework to the appropriate angle.

Referring now to FIGS. 2 to 6, there is shown another embodiment of the invention. Where parts of the embodiment now described correspond to parts of the device described with reference to FIGS. 16 and 17, like reference numerals are used.

Referring first to FIGS. 2 to 6, the mine roller apparatus 20 comprises a frame 4, which includes an A frame formed by structural members 22, 23, formed for example from tubular steel. A push bar 21 extends from the apex of the A-frame and terminates in a hook 21*a*, which attaches to a pintle 9 of the pushing vehicle. Frame 4 supports a shaft 25, which is hollow in the illustrated example, and which extends in a substantially perpendicular direction to the longitudinal axis of the apparatus 20. Two elements of the mine roller steering mechanism are mounted on the shaft 25, a first member 24 which is an elongate member and a second member in the form of a bracket 26. The shaft 25 passes through the end of the member 24 proximate the A frame and the bracket 26. A bracket 27 is attached to the elongate member 24 towards the free end thereof. One end of a rod 28 is pivotably connected to the bracket 27, the other end of the rod being pivotally connected to the pushing vehicle 10 by means of a pivot attachment 29. The rod 28 forms part of a feedback system. The elongate member 24 mounts another bracket 30 to which one end of an extensible actuator 31, in the form of a hydraulic ram in the present example, is attached. The other end of the actuator 31 is attached to a bracket 26 by a pivot attachment 32, which may comprise a pin passing through holes in the bracket 26 and the end of the actuator 31. The bracket 26 is also pivotally mounted on the shaft 25, that is it may rotate about the shaft 25. The actuator 31 serves to change the angle of the member 24 relative to the bracket 26. A tie rod 36 extends between and is pivotally attached to the bracket 26 at pivot attachment 33 and a connector in the form of a plate 35 of a roller steering linkage. The plate 35 is pivotably attached to a bracket 58, which is attached to the frame 23 by a bracket 59. The shaft 25, elongate member 24 and bracket 26 are illustrated in detail in FIG. 13.

The apparatus includes a steering angle sensor 141 for sensing the steering angle of the steering wheels (the front wheels 10*a*, 10*a*') of the pushing vehicle 10. Of course the steering angle of the steering wheels need not be measured directly. Any measuring device connected to the pushing vehicle's steering mechanism, and arranged to measure a parameter of the vehicle's steering mechanism from which the vehicle's turning circle may be calculated may be used. The PLC runs an algorithm that calculates the length at which actuator 31 must be set to move the roller sets 1, 2 to a position in which the roller sets pass over the track of the inner most wheel of the pushing vehicle (this corresponds approximately to the calculation of the length of the actuator 5 to provide angle A described with reference to FIG. 17).

In this example the rod 28 is of fixed length. Hence, the rod 28, the push bar 21 the elongate member 24 and the part of the front of the pushing vehicle 10 extending between the pintle 9 and the pivot attachment 29 form a four bar linkage.

Figure 7:
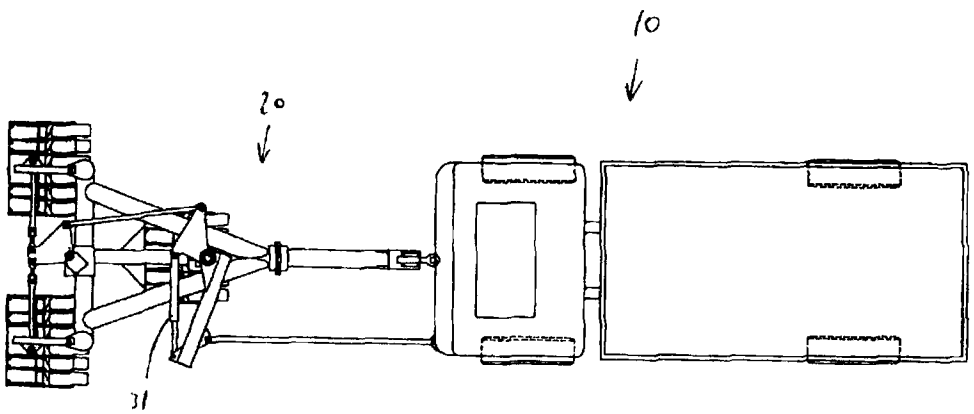
FIGS. 7 to 12 illustrate the combination of the device and the pushing vehicle executing a turn where.
Figure 8:
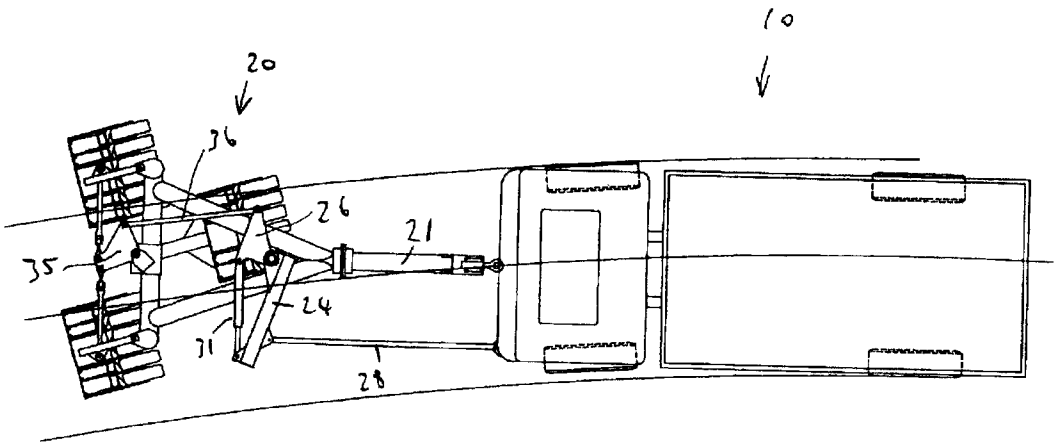
Figure 9:
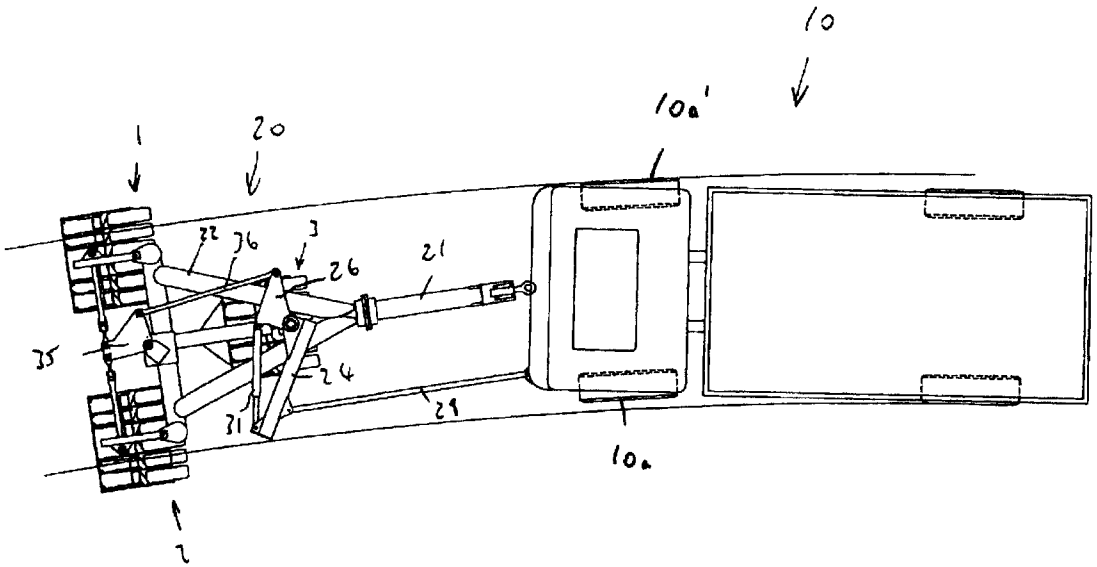

The movement of the mine clearance apparatus will now be described with reference to FIGS. 7 to 9 and 10 to 12. In FIG. 7 the pushing vehicle 10 is just about to commence a turn to the left. In FIG. 8 the pushing vehicle 10 has turned the front wheels 10*a*, 10*a*$^1$ to the left. As the wheels of vehicle are being steered to the left, the steering angle sensor detects the angle through which the front wheels have been turned (to a turning radius requiring an angle A of 10 degrees in this case) and the PLC calculates the require length of actuator 31 to position the mine clearance apparatus 20 in relation to the pushing vehicle 10 such that the path followed by at least a part of the roller set 2 (the inner roller set when turning to the left) passes over the path that the unsteered inner wheel of the pushing vehicle (in the example the left hand rear wheel) will follow when executing the turn.

Hence, when the actuator 31 is retracted to the length required by PLC, the plate 35 is caused to rotate anti-clockwise. The roller sets 1, 2 are connected to the plate 35 by track rods 7, 8, and hence turning the plate 35 anti-clockwise in turn turns the roller sets 1, 2 anti-clockwise relative to the beam 23.

With the roller sets 1, 2 set in the position illustrated in FIG. 8 the mine clearance apparatus 20 tracks across to the left towards the desired position as the apparatus is pushed forwards. As the apparatus 20 moves from the position illustrated in FIG. 8 to the position shown in FIG. 9, the change in shape of the above-mentioned four bar linkage causes the bracket 26 and hence the plate 35 to turn clockwise until the position illustrated in FIG. 8 is reached where the assumed steering angle of roller sets 1, 2 corresponds to that which is required to keep the apparatus 20 on the turning radius that ensures that the path traversed by at least a part of the inner roller set 2 covers the path traversed by the left rear wheel 10*b* of the vehicle 10, and the path traversed by at least a part of the outer roller set 1 covers the path traversed by the right front wheel 10*a*' of the pushing vehicle 10.

Figure 10:
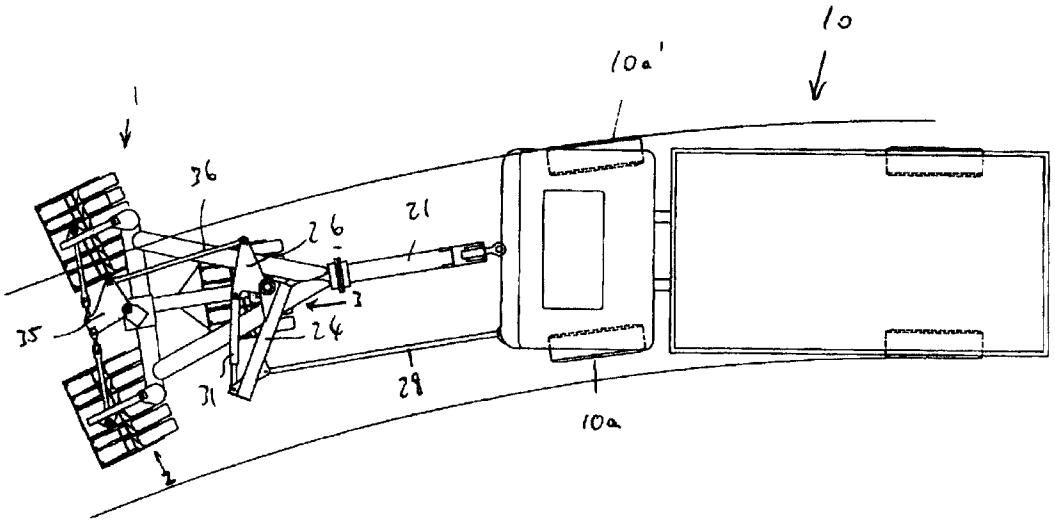
Figure 11:
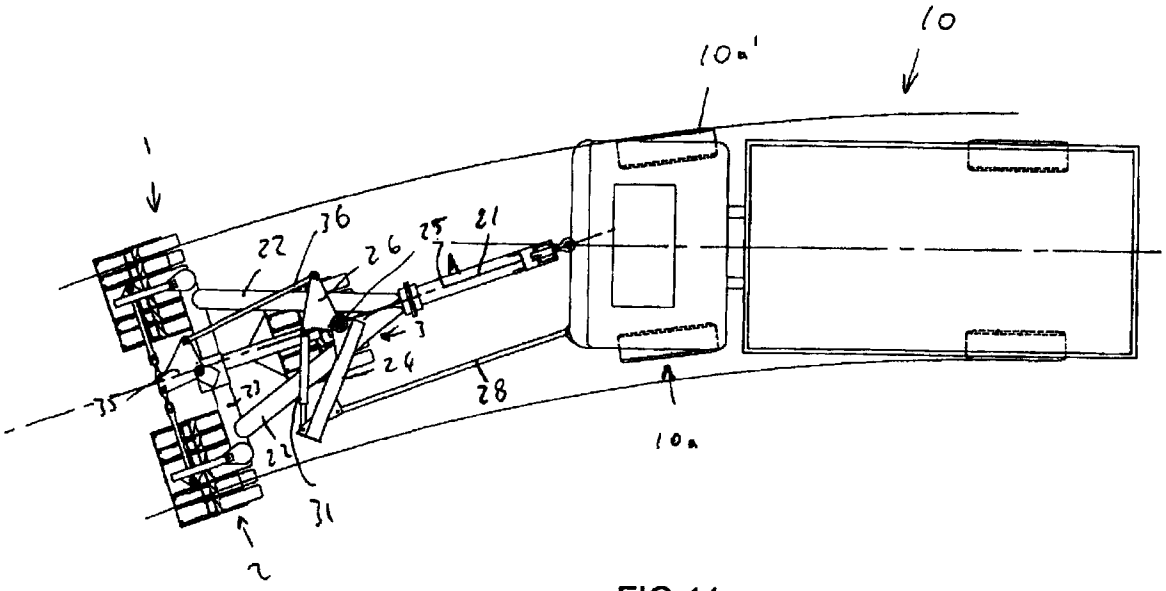

In FIG. 10 the driver of the pushing vehicle has turned to wheels 10*a*, 10*a*$^1$ to reduce the turning radius of the pushing vehicle, increasing the required angle A to 20 degrees, this decrease in turning radius of the pushing vehicle occurring as the vehicle moves forwards. Again, the PLC determines the required length of actuator 31 and causes the length thereof to be changed. The roller sets 1, 2 are turned anti-clockwise and the apparatus tracks across to the left to assume to position illustrated in FIG. 11, in which the paths traversed by the wheels of the pushing vehicle are covered by the rollers 1, 2.

Figure 12:
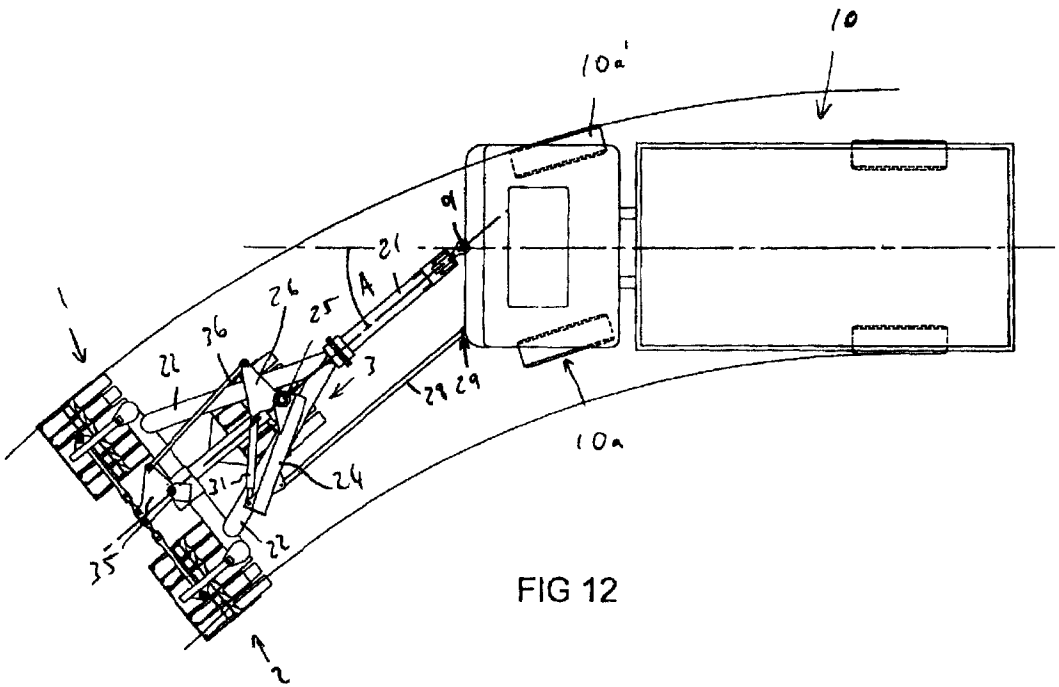
Figure 13:
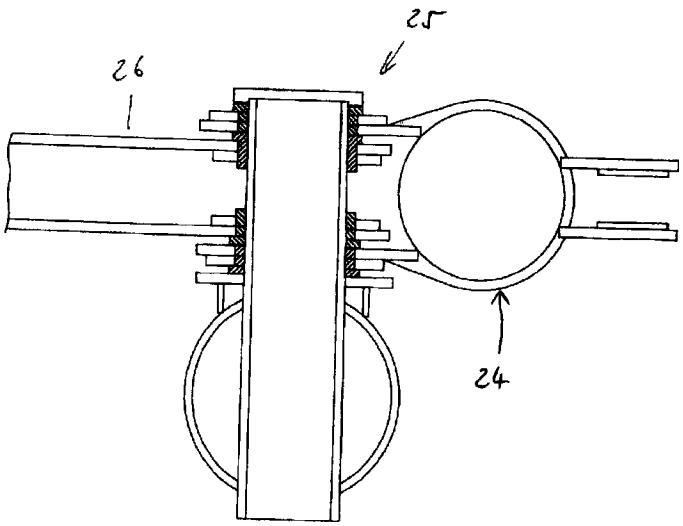
FIG. 13 is a schematic representation of parts of the alignment linkage of the first embodiment of the invention.

In FIG. 12, the driver of the pushing vehicle 10 has reduced the turning radius of the pushing vehicle still further, increasing the required angle A to 40 degrees, the change in turning radius causing the length of the actuator 31 to decrease to provide the required angle A. The apparatus tracks across to the left.

In each of the Figures referred to above, a roller set 3 is illustrated. The roller set 3 is situated between roller sets 1 and 2, and is not steering in the same manner as roller sets 1 and 2. Roller set 3 is attached to the structural member 23 by means of a pivot linkage 60 comprising a towing eye 62 extending from a draw bar of the roller set 3, a clevis hitch 64 and a pin 63 configured to pass through aligned holes in the towing eye 62 and clevis hitch 64 (see FIG. 5 in particular).

In the Figures the outer roller sets 1, 2 are steerable and the centre roller set 3 is unsteered, but follows the steered path because it is connected to the apparatus as described above. It may be envisaged that the centre roller set may be steered as well as the outer roller sets. Further, it may be envisaged that the centre roller may be steered and the outer rollers unsteered, but connected to the apparatus in a manner that provides for them to be able to follow the path determined by the steered centre wheel set, for example using the method of attachment to the structural member 23 as described above in relation to roller set 3.

Figure 2:
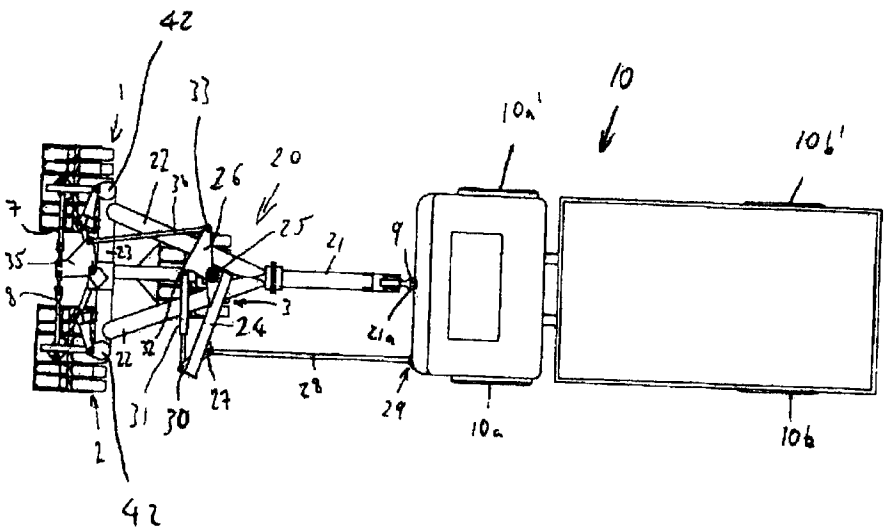
FIG. 2 is a plan view of a device according to a first embodiment of the invention on a straight heading.
Figure 3:
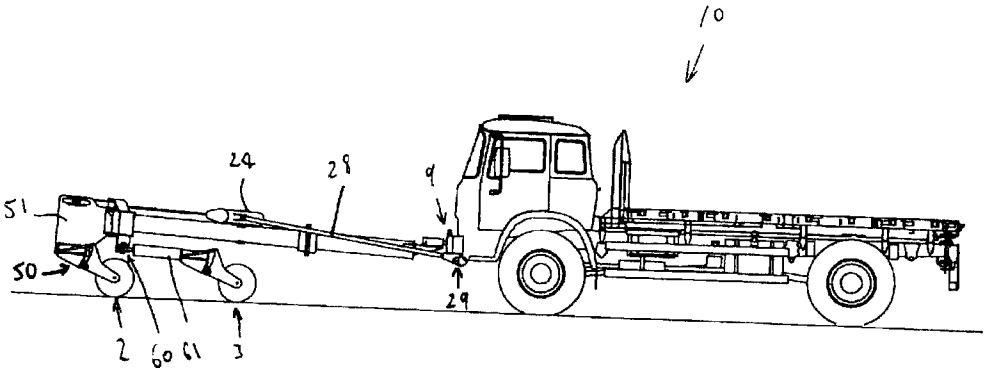
FIG. 3 is a side view of the device illustrated in FIG. 2.

In addition to providing for the roller sets 1, 2 to clear the path of the inner most wheel of the pushing vehicle, the linkage arrangement of the apparatus and its geometry provide that the apparatus will always come to an equilibrium position corresponding to the steering angle and hence desired path of the pushing vehicle and will return to the desired path after any deviation therefrom, i.e. the linkage arrangement provides a feedback system. This feature is now described with reference to FIGS. 2 and 18. Referring to FIG. 2, if for example, one of the rollers were to hit a large stone and the apparatus 20 were thrown across to the right to the position illustrated in FIG. 18, without the driver of the pushing vehicle 10 making any corrective steering input, the apparatus 20 would be caused to return to the set steered path because the deviation of the apparatus to the right would cause the shape of the four bar linkage to change causing the elongate member 24 to rotate anti-clockwise about shaft 25, which due to the fixed length of actuator 31 causes the bracket 26 to rotate anti-clockwise about shaft 25, which due to the action of the tie rod 36 causes the plate 35 to also rotate anti-clockwise, which in turn causes the roller sets 1 and 2 to take up a position to steer the apparatus 20 to the left. As the apparatus 20 returns to the desired path the four bar linkage returns to the correct shape for the desired path and the combination of the apparatus and pushing vehicle return to a steady state. In this example the feedback signal representing the deviation of the apparatus from the desired angle A, is provided by the mechanical linkage, in particular, the mechanical link attaching the steering mechanism to the vehicle provided by rod 28.

Figure 19A:
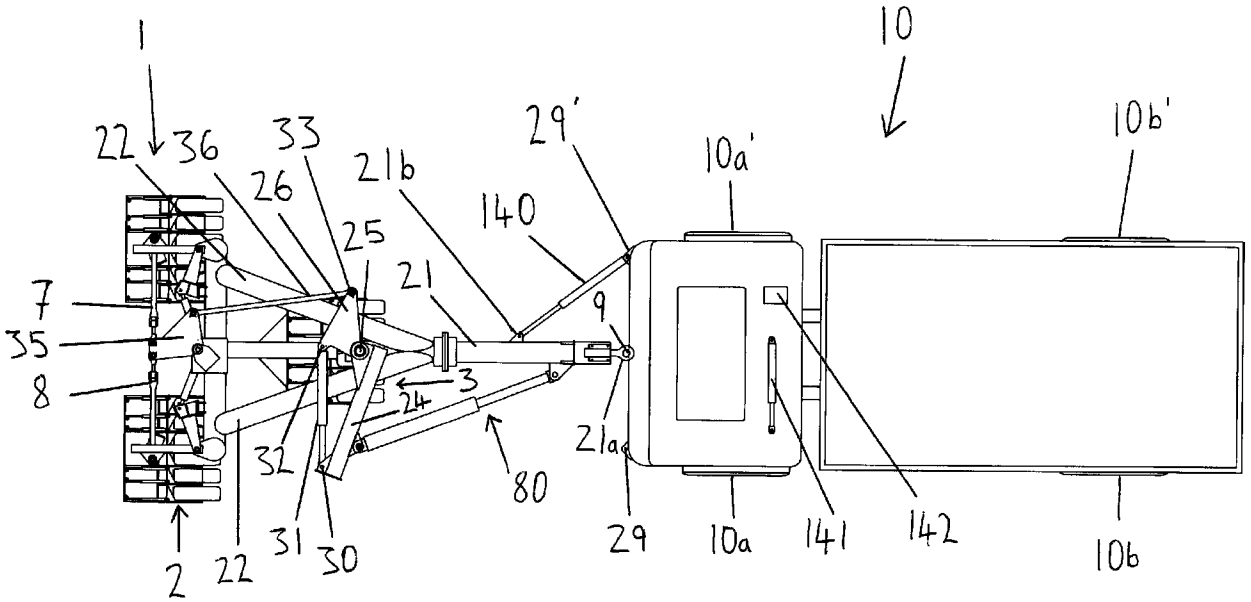
FIG. 19*a* is a plan view of a device according to another embodiment of the invention on a straight heading.
Figure 20:
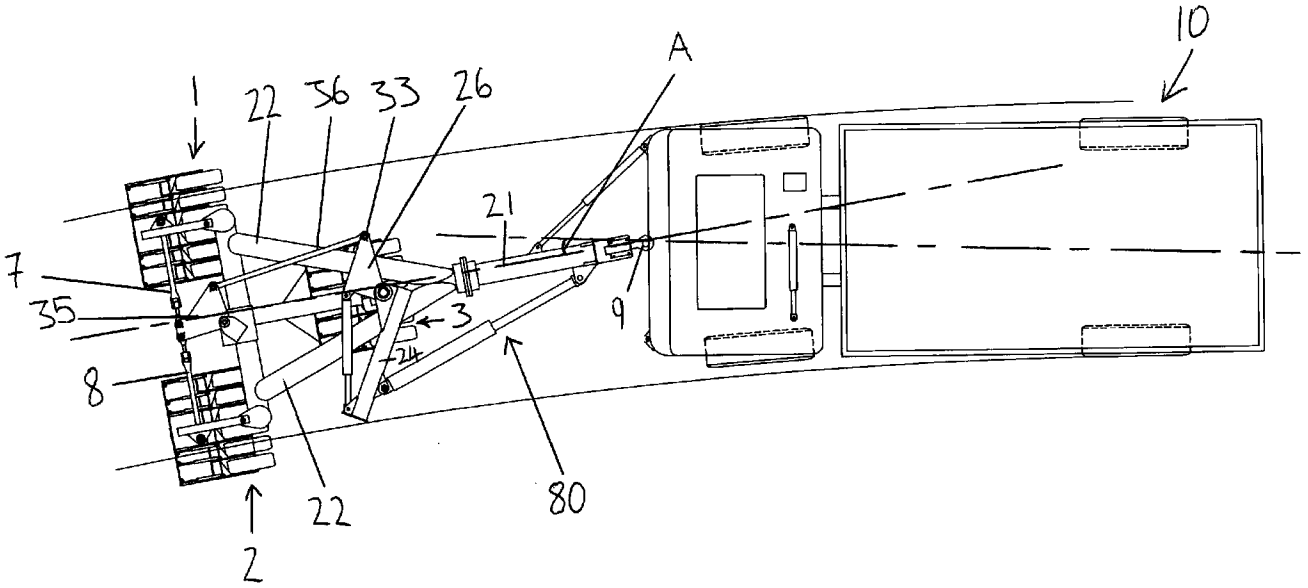
FIG. 20 is a plan view of the device illustrated in FIG. 19*a* following a deviation from a desired path.

However, the feed back system need not be wholly mechanical arrangement. For example, the link 28 could be replaced with a linear actuator 80 as shown in FIGS. 19*a* and 20, one end being connected to the elongate member 24 and the other to a fixed part of the apparatus, for example the push bar 21. A transducer 140 may be provided to generate an electronic signal representative of the actual angle A, which may be compared with the calculated angle A in the PLC. In the illustrated example transducer 140 is connected to the pushing vehicle 10 and the push bar 21. The PLC may be programmed to generate a signal which is used to adjust the length the actuator 80 and hence change the steering angle of the roller sets 1, 2 to bring the apparatus back such that the angle A is the calculated angle A. Such an electronic feed back arrangement would operate on a continuous loop and adjust the length of the actuator 80 as the apparatus returned to the desired path, or upon the return of the apparatus to the calculated angle A. Electronic communication between the pushing vehicle 10 and the apparatus maybe by wire or wireless.

Figure 19B:
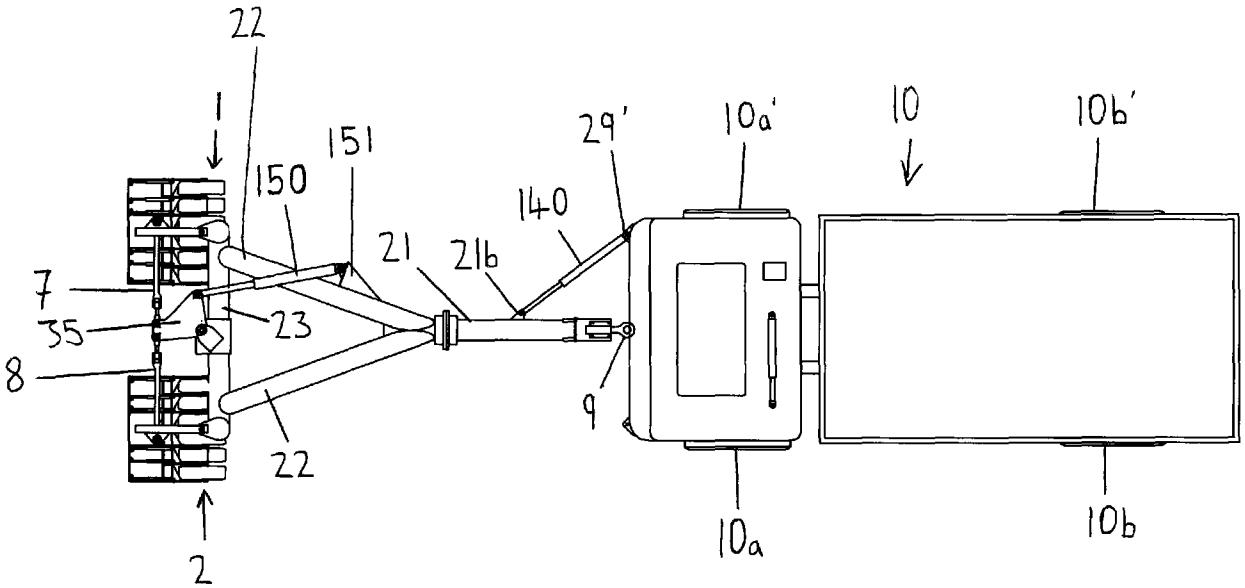
FIG. 19*b* is a plan view of an alternative embodiment of the device shown in FIG. 19*a;*

An alternative electronic feedback signal could utilise the actuator 31. In such an arrangement, the link 28 would be removed, and the actuator 31 would extend between a fixed object (the position of member 24 may be fixed) and the bracket 26. The required length of actuator 31 to provide the required angle "A" would be calculated as described above. If the apparatus were to hit an object resulting in a deviation to the right, the actual angle A would not correspond to the required angle A. This difference may be used to calculate a new length of actuator 31 to adjust the steering angle of the roller sets 1, 2 to bring the apparatus back to the path as described in the preceding paragraph. FIG. 19*b* also shows an embodiment using an electronic feedback system. The actuator 150 extends between a bracket 151 attached to frame member 22 and the plate 35. The required length of actuator 150 to provide the required angle "A" would be calculated as described above. If the apparatus were to hit an object resulting in a deviation to the right, the actual angle A would not correspond to the required angle A. This difference may be used to calculate a new length of actuator 150 to adjust the steering angle of the roller sets 1, 2 to bring the apparatus back to the path as described in the preceding paragraph.

Figure 4:
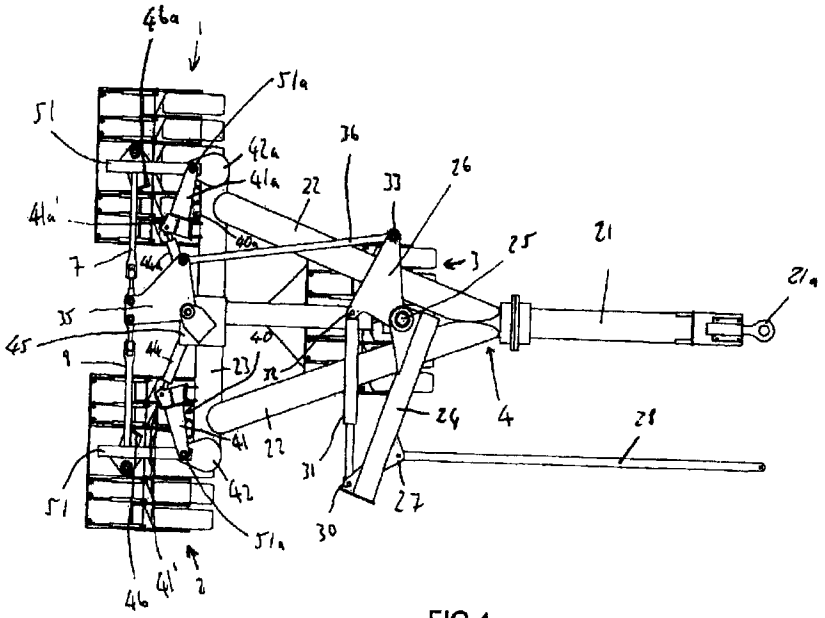
FIG. 4 is a plan view of the device illustrated in FIGS. 2 and 3 unhitched from the pushing vehicle.
Figure 6:
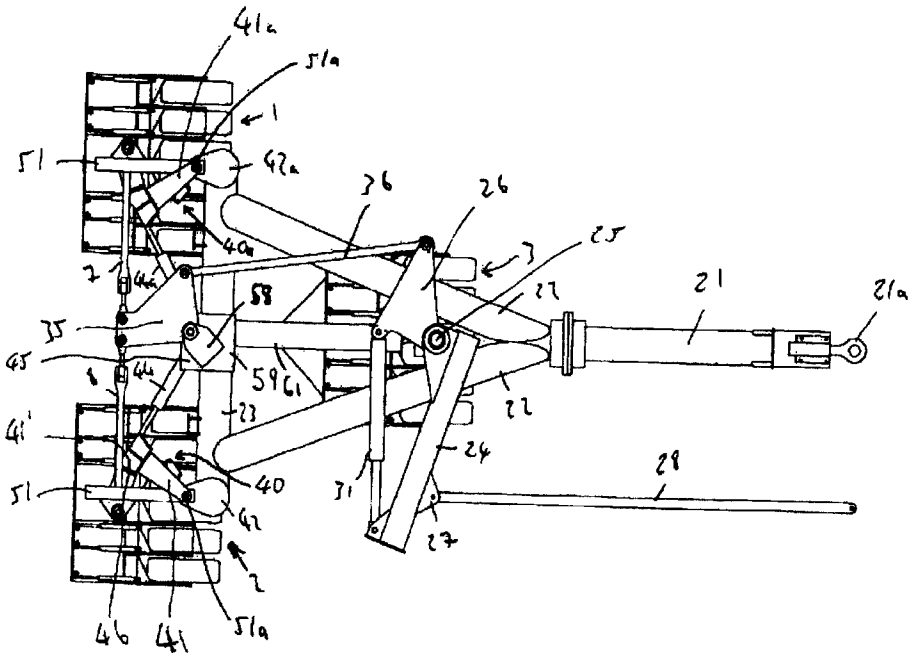
FIG. 6 is a plan view of the device illustrated in FIGS. 4 and 5 locked for reversing.

A feature of the apparatus 20 is that whilst it is inherently stable whilst being pushed forward, it is inherently unstable when the pushing vehicle is reversed. It would be undesirable for reversing the combination of the pushing vehicle 10 and apparatus 20 to be difficult. To alleviate the problem of inherent instability when reversing, the apparatus 20 includes reversing locks 40, which in the illustrated example are operable remotely from the cab of the pushing vehicle 10. Referring specifically to FIGS. 4 and 6, each reversing lock 40, 40*a* comprises a swing arm 41, 41*a*, one end of which is pivotally connected to a bracket 42, 42*a* mounted on the structural member 23. An actuator 44, 44*a*, in the form of a hydraulic ram in the illustrated example, is pivotally attached to the other end of the swing arm 41, 41*a*, and to bracket 45 which is mounted on the structural member 23. The reversing lock also includes a stop 46.

In FIG. 6, both roller sets 1, 2 are locked. In the locked state, it can be seen that the actuator 44 is extended and the swing arm 41 is in engagement with the stop 46 which is attached to the roller mount, and similarly, swing arm 41*a* is in engagement with its corresponding stop. Hence, rotation of the roller sets 1, 2 about their substantially vertical axes is prevented.

In FIG. 4, the steering locks 40, 40*a* associated with the roller sets 1 and 2 are shown in their unlocked state. In this state the roller set 2 pivotally mounted with respect to structural member 23 by means of a member 51 may rotate about its substantially vertical axis, the range of rotation to the left being limited by the engagement of the stop 46 with the surface 41' of the swing arm 41. Roller set 1 may rotate about its substantially vertical axis in a counter clockwise direction to an amount limited by the engagement stop 46*a* with the surface 41*a*' of the swing arm 41*a*.

With the steering lock in the locked configuration, pivotal movement between the pushing vehicle 10 and the apparatus 20 must be provided for in order for the combination to execute a turn. This could be achieved in a number of ways. For example, the rod 28 may be detached, or the tie rod 36 may be detached. However, both of these methods would require a person to walk from the pushing vehicle 10 to the apparatus 20. Given that there is potential for unexploded IED's to be present, it is highly desirable that the operator should remain in the vehicle. Hence, the preferred means of providing for pivotal movement between the pushing vehicle 10 and the apparatus 20 is to provide the valve controlling the length of actuator 31 with a float setting, and a control means in the cab of the vehicle 10 to allow the valve to be switched to float mode. With the actuator in float mode the elongate member 24 is free to pivot about shaft 25 and hence the vehicle 10 may pivot with respect to the apparatus 20.

The roller set 3 is simply lifted clear of the ground during reversing, for example by means of a winch or hydraulic ram.

Figure 14:
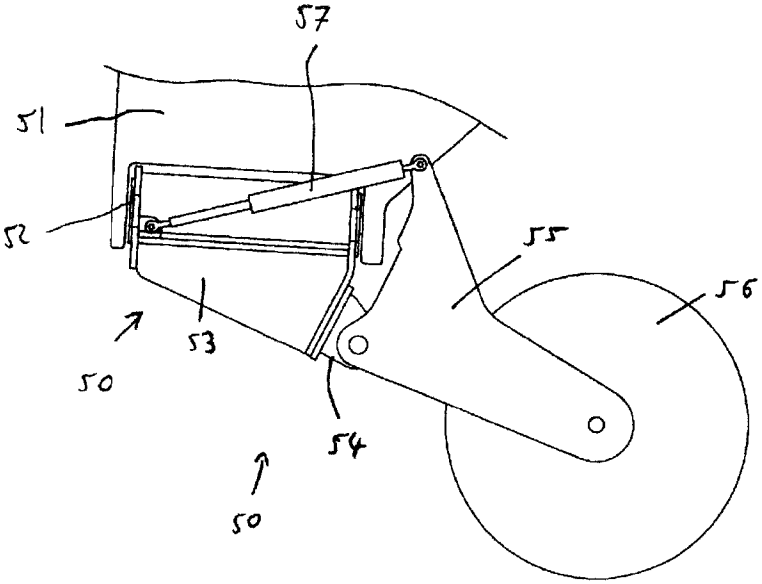
FIG. 14 is a side view of a ground engaging wheel of the device.

Referring now to FIG. 14, each roller 56 of the roller sets 1 to 3 is mounted to pivot about a substantially horizontal axis, and a biasing means 57 (such as a gas spring, coil spring or hydraulic ram and accumulator) is provided to ensure that each individual roller 56 follows the surface over which it traverses.

Figure 15:
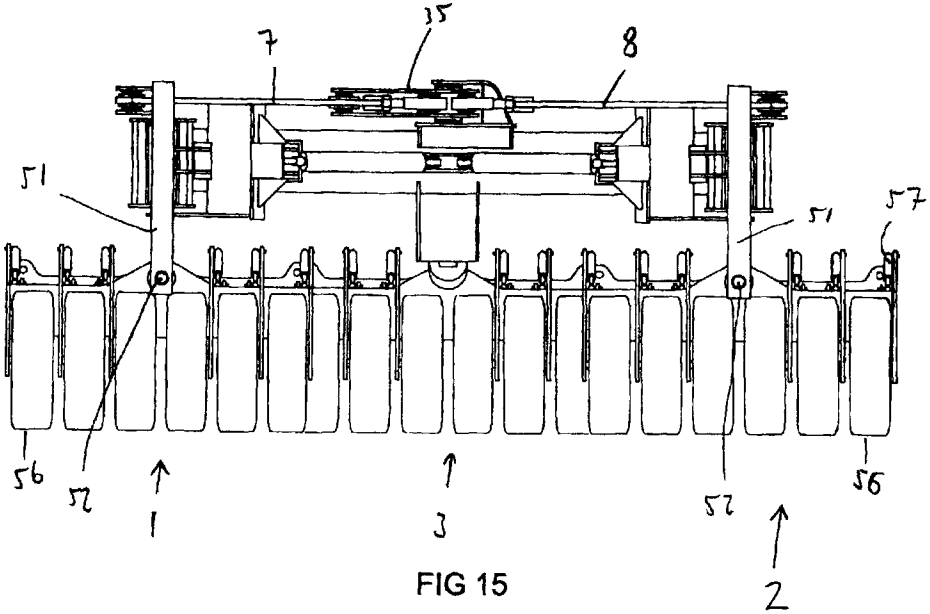
FIG. 15 is a front view of the device.

Referring now to FIGS. 14 and 15, each roller set 1, 2 is mounted on pivot mount 50, the pivot axis of which lies in a substantially horizontal plane about a pin 52, which engages with an arm 51 that is attached to the bracket 42 of frame 4 by a pin 51*a*, which provides for the roller set to pivot in the substantially vertical axis of the pin 51*a*. Further, the wheel 56 is mounted on a bracket 55 which is in turn pivotably mounted on a bracket 54 by means of a pin or the like, the bracket 54 being connected to a plate 53 which is mounted on the pin 52. A biasing means, such as a gas spring (or coil spring, or a hydraulic ram and accumulator or any other suitable biasing means) 57 extends between the bracket 55 and the plate 53. Such a mounting provides for the roller sets 1, 2, 3 to follow ground undulations and mitigates against IED's being missed simply because they lie in a hollow between the extreme edges of the roller sets 1 to 3. Regarding the roller set 3, roll movement of the roller set may be accommodated by a pivot mount extending rearward from the drawbar 61 substantially along the axis of the drawbar, or alternatively, the hitching of the drawbar 61 to the frame may include a ball hitch or a ball link.

Ballast weights may be provided within or attached to the arm 51 to ensure that there is adequate weight on the wheels 56 of rollers 1 to 3.

The extension of the ram 31 is preferably not abrupt. Advantageously, the steering angle of the vehicle is sensed at small time intervals so that the change the length of the ram 31 occurs gradually so that in practice the cylinder moves and wheelsets start to turn as the vehicle starts to turn.

FIGS. 21, 21*a* and 22*a* to 22*c* illustrate another embodiment of a mine roller apparatus of the invention. In this embodiment the linear (hydraulic) actuator 31 illustrated in FIGS. 2 to 6 for example is replaced with an actuator comprising a motor and a gearbox. Where parts of the embodiment now described correspond to parts of the apparatus described with reference to FIGS. 2-6, like reference numerals are used.

Referring now to FIGS. 21, 21*a* and 22*a* to 22*d*, the mine roller apparatus 20 comprises a frame 4, which includes an A frame formed by structural members 22, 23, formed for example from tubular steel. A push bar 21 extends from the apex of the A-frame and terminates in a hook 21*a*, which attaches to a pintle 9 of the pushing vehicle. This embodiment differs from the previously described embodiments in the nature of the actuator used to operate the tie rod 36 which attaches to the plate 35 of the steering linkage mechanism. The steering linkage mechanism is identical to the steering linkage mechanism described with reference to FIGS. 2 to 6 and hence is not described in detail with reference to FIGS. 21 and 22*a* to 22*c*.

An actuator 100 comprises a motor 101 and gearbox 102. An output shaft 101*a* of the motor 101 is connected to the input shaft 102*a* of the gearbox 102 by a coupling 103. A bracket 26 is mounted on the output shaft 104 of the gearbox 102 so that the bracket 26 rotates with the output shaft 104 about the axis 105. As can be seen from FIG. 22*b*, the bracket 26 is attached to both the gearbox output shaft 104 and one end of the tie rod 36.

Both the motor 101 and gearbox 102 are mounted on a support 124 which is provided with brackets 27 and 127 on opposing faces thereof. Each bracket 27, 127 includes holes 27', 127' for receiving a pin (not shown). The bracket 127 provides for attachment of the support arm 124 to the frame 4, for example to structural member 22. This is achieved by passing a pin (not shown) through the holes 127' and a part of the frame 4. When so mounted the support arm 124 may pivot about the pin.

One end of a rod 28 is pivotably connected to the bracket 27 by a pin (not shown) extending through holes 27' provided in the bracket 27 and a corresponding hole (not shown) in the end of the rod 28, the other end of the rod being pivotally connected to the pushing vehicle (not shown) by means of a pivot attachment 29. The rod 28 forms part of a feedback system. The actuator 100 serves to change the angle of the support arm 124 relative to the bracket 26. The tie rod 36 that extends between and is pivotally attached to the bracket 26 at pivot attachment 33 and a connector in the form of a plate 35 of a roller steering linkage.

The motor 101 illustrated in FIGS. 21 and 22*a* to 22*c* is an electric motor. In this embodiment the electric motor 101 is connected to a battery power pack 128, which comprises a battery mounting plate 129 and two batteries, typically 12 volt batteries, connected together by suitable cabling 131 to provide a 24 volt supply via cables 132 to the motor 101. It is advantageous that the batteries should be charged continuously. The pushing vehicle is an ideal source of electrical power that may be utilised to charge the batteries 130. In this embodiment a battery charger 133 is mounted on the support arm 124 and is electrically connected to the batteries 130. As can be seen from FIGS. 21 and 22*b*, the battery charger is electrically connected to the batteries 130 at the electrical inputs of the motor 101. In this way the motor may draw charge directly from the charger 133, or from the batteries 130 and the charger may charge the batteries 130.

The apparatus includes a steering angle sensor 141 for sensing the steering angle of the steering wheels (the front wheels 10*a*, 10*a*') of the pushing vehicle 10. The turning radius of the pushing vehicle may be calculated from the sensed steering angle. Of course the steering angle of the steering wheels need not be measured directly. Any measuring device connected to the pushing vehicle's steering mechanism, and arranged to measure a parameter of the vehicle's steering mechanism from which the vehicle's turning circle may be calculated may be used. The PLC runs an algorithm that calculates the rotational position of the output shaft 104 of the gearbox 102 must be set to move the roller sets 1, 2 to a position in which the roller sets pass over the track of the inner most wheel of the pushing vehicle (this corresponds approximately to the calculation of the length of the actuator 5 to provide angle A described with reference to FIG. 17 and the calculation of the length of actuator 31 in FIGS. 2 to 6).

Figure 21:
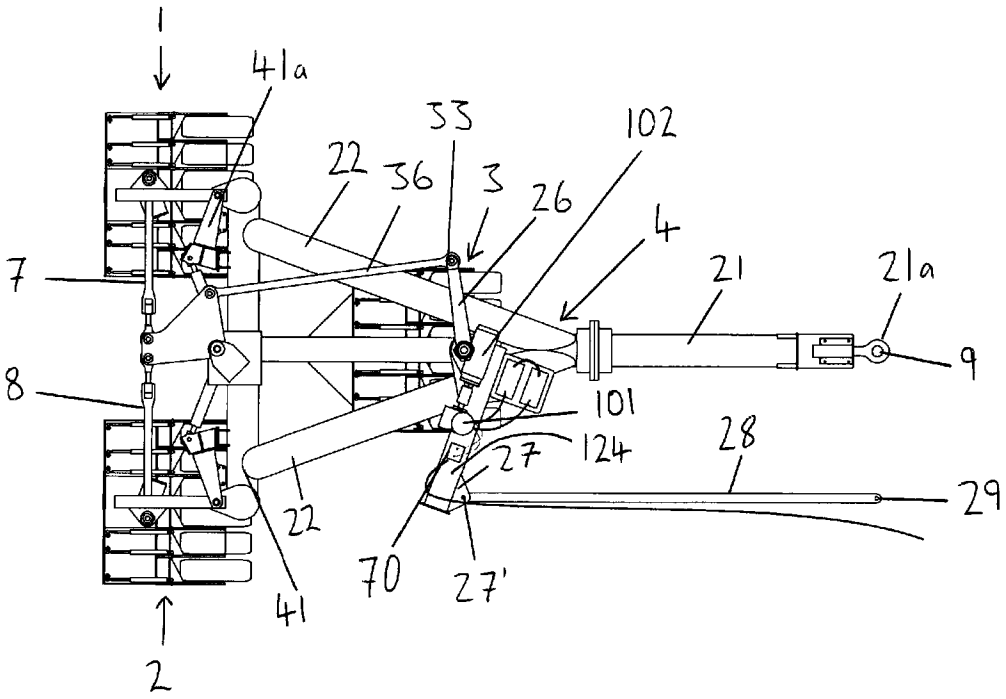
FIG. 21 is a plan view of a device according to another embodiment of the invention on a straight heading.

In FIG. 21 the rod 28 is of fixed length. Hence, the rod 28, the push bar 21 the support arm 124 and the part of the front of the pushing vehicle 10 extending between the pintle 9 and the pivot attachment 29 form a four bar linkage. This arrangement does not provide a neutral setting for reversing. Note, for the sake of clarity the linear transducer 155 is not shown in this Figure. The linear transducer 155 would be mounted in the embodiment shown in FIG. 21 in the same manner as shown with reference to FIG. 21*a*.

Figure 21A:
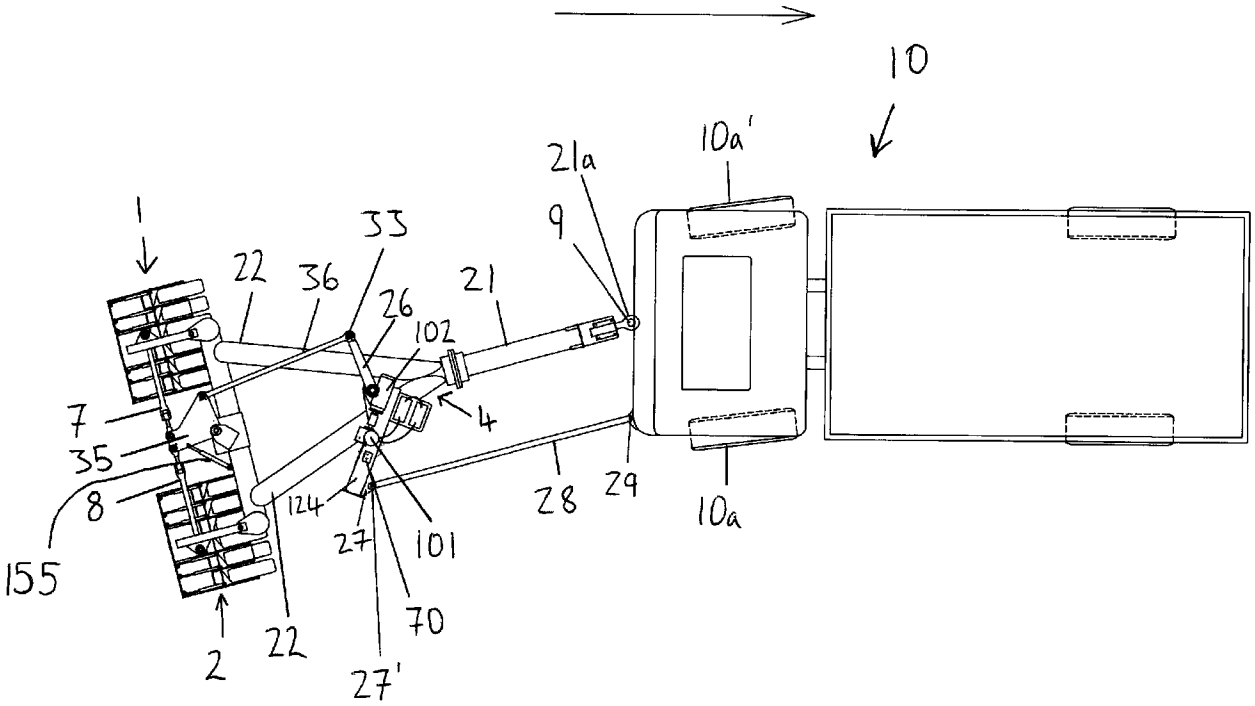
FIG. 21*a* is a plan view of the device shown in FIG. 21 attached to a pushing vehicle.
Figure 22B:
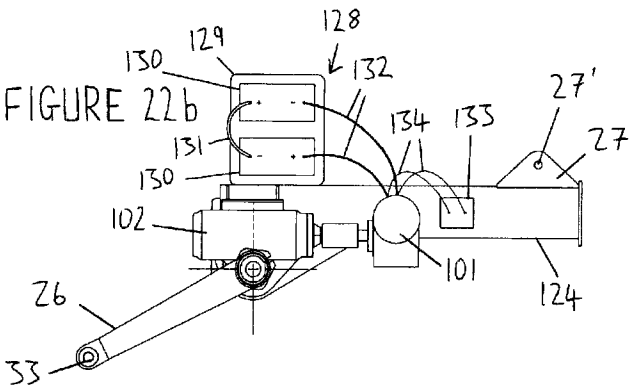
FIG. 22*b* is a side view of the actuator shown in FIG. 22*a;*
Figure 22A:
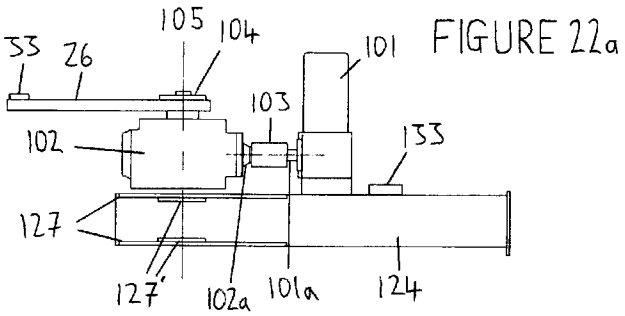
FIG. 22*a* is a plan view of an actuator of the device illustrated in FIG. 21.
Figure 22C:
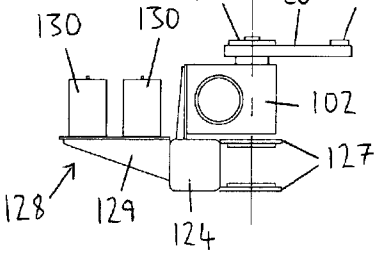
FIG. 22*c* is a front view of the actuator shown in FIGS. 22*a* and 22*b;*

In FIG. 21*a*, no steering locks 41, 41*a* are shown, whereas in FIG. 21 steering locks are shown. The steering locks 41, 41*a* may be desirable even when the actuator of the apparatus does not provide a neutral setting in the event that the actuator fails. The wheel sets 1, 2 can then be set in a fixed orientation.

Figure 23:
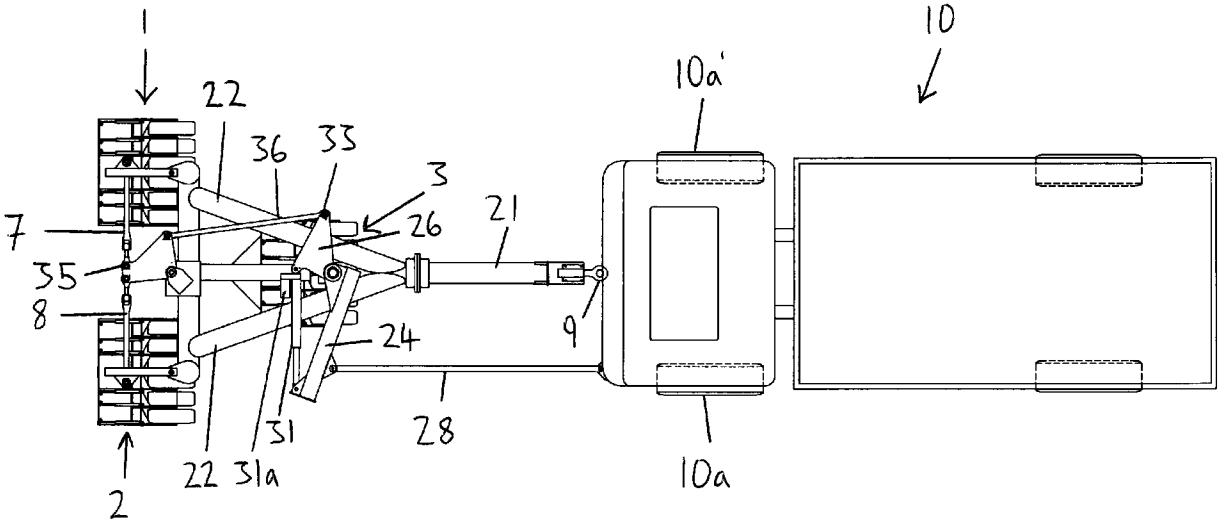
FIG. 23 illustrates a device similar to that shown in FIGS. 2 to 12 with a different type of actuator.

FIG. 23 illustrates an embodiment of the apparatus corresponding substantially to that shown in FIGS. 2 to 12. The difference lies in the form of actuator 31. In FIG. 23 the actuator 31 is a linear actuator but instead of being powered by hydraulic fluid it is powered by an electric motor and gearbox 31*a*. In FIG. 23 reference numerals have only been provided for only a limited number of components. FIGS. 2 to 12 may be referred to as the FIG. 23 embodiment differs only in the nature of the actuator 31.

Figure 24:
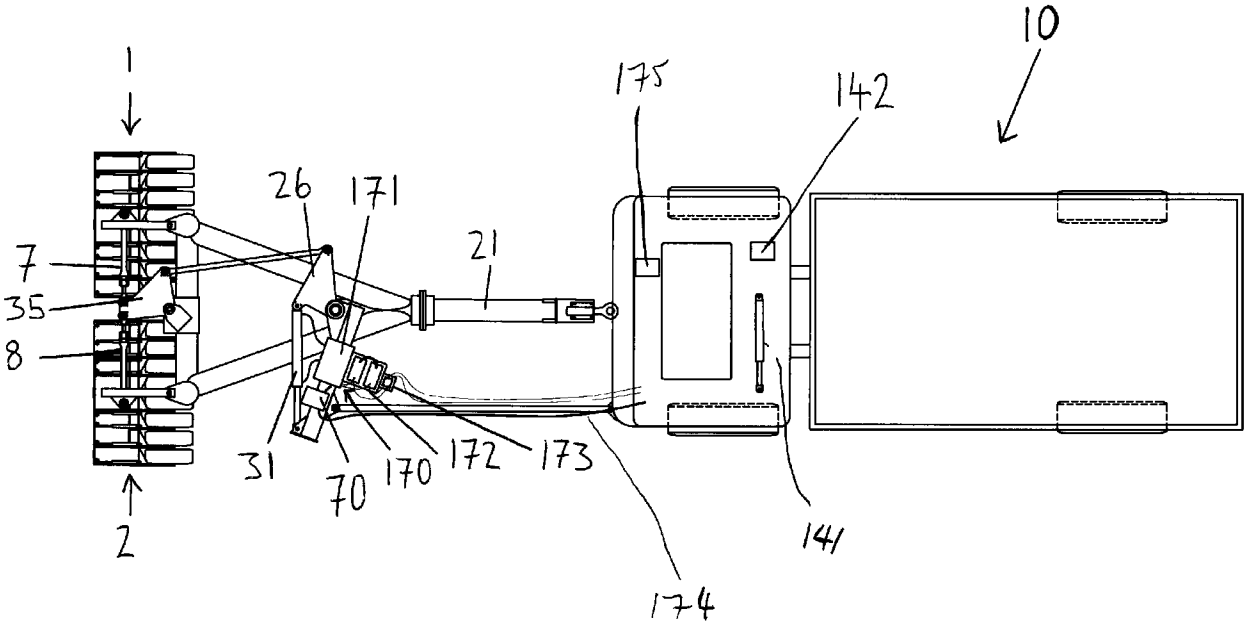
FIG. 24 illustrates a device similar to that shown in FIGS. 2 to 12 with an alternative roller configuration.

FIG. 24 illustrates another embodiment of the apparatus corresponding substantially to that shown in FIGS. 2 to 12. The difference lies in the absence of the unsteered roller set 3. Each steered roller set 1, 2 is wider than in the embodiment shown in FIGS. 2 to 12, thereby engaging the ground that the unsteered roller 3 in the FIGS. 2 to 12 embodiments would engage. The embodiment illustrated in FIG. 24 shows a hydraulic power pack 170 which includes an electrically powered hydraulic pump and control valve set 171, a battery pack 172 and battery charger 173, the charger connectable to the electricity supply of the pushing vehicle 10. Also shown is the PLC 70 which calculates the required angle A in the manner described above and controls hydraulic valves in the control valve set to change the extension of actuator 31. The PLC 70 is electrically connected to the host vehicle 10 by a cable 174 so that it may receive electrical signals from the steering angle sensor 141 and the human machine interface 175. Note, a junction box 142 is provided. The steering angle sensor 141, the human machine interface 175 and the cable 174 may each be electrically connected to the junction box 142.

Figure 25:
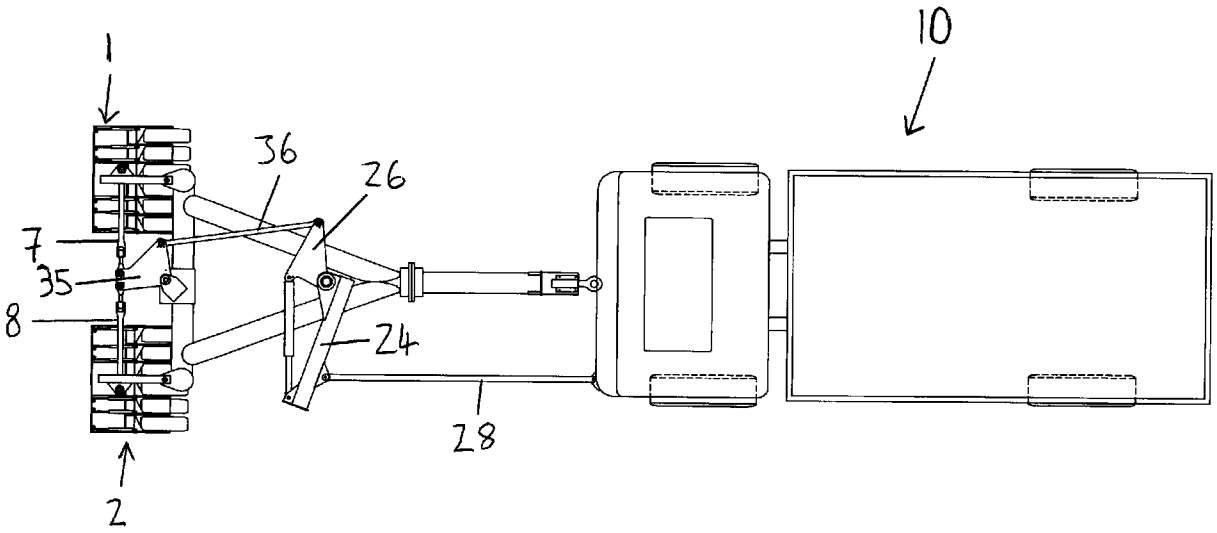
FIG. 25 illustrates a device similar to that shown in FIGS. 2 to 12 with another alternative roller configuration.

FIG. 25 illustrates another embodiment of the apparatus corresponding substantially to that shown in FIGS. 2 to 12. The difference lies in the absence of the unsteered roller set 3. A space is left between the two roller sets 1, 2. The paths of the wheels of the pushing vehicle are cleared but a central strip between the paths of the wheels of the pushing vehicle is not cleared. This may be useful where a roadway comprises two spaced apart tracks and/or where the pushing vehicles available are insufficiently powerful to push an apparatus having three roller sets 1 to 3.

Figure 26:
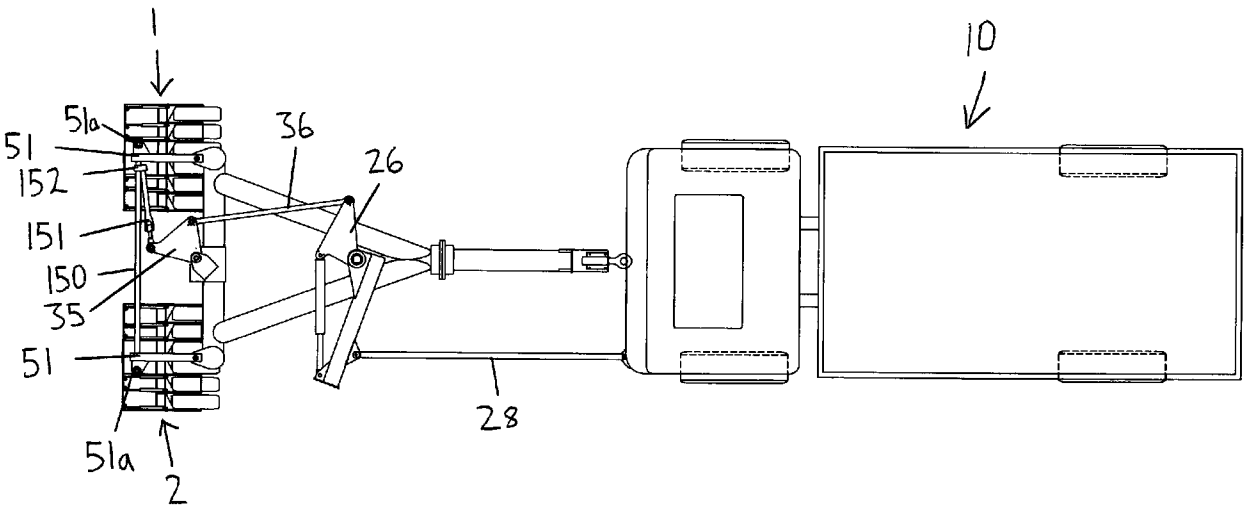
FIG. 26 illustrates a device similar to that shown in FIGS. 2 to 12 with an alternative roller steering linkage mechanism.

FIG. 26 illustrates another embodiment of the apparatus corresponding substantially to that shown in FIGS. 2 to 12. The difference lies in the steering linkage. The arms 51 are connected together by a tie rod 150 and a steering rod 151 extends from the plate 35 and attaches to the tie rod 150. The tie rod 150 attaches to brackets 51*a* extending from the arms 51 and the steering rod attaches to the plate 35, the respective attachments providing for pivoting between the so attached components. The steering rod 151 is attached to the tie rod 150 by a flexible coupling 152.

Figure 27:
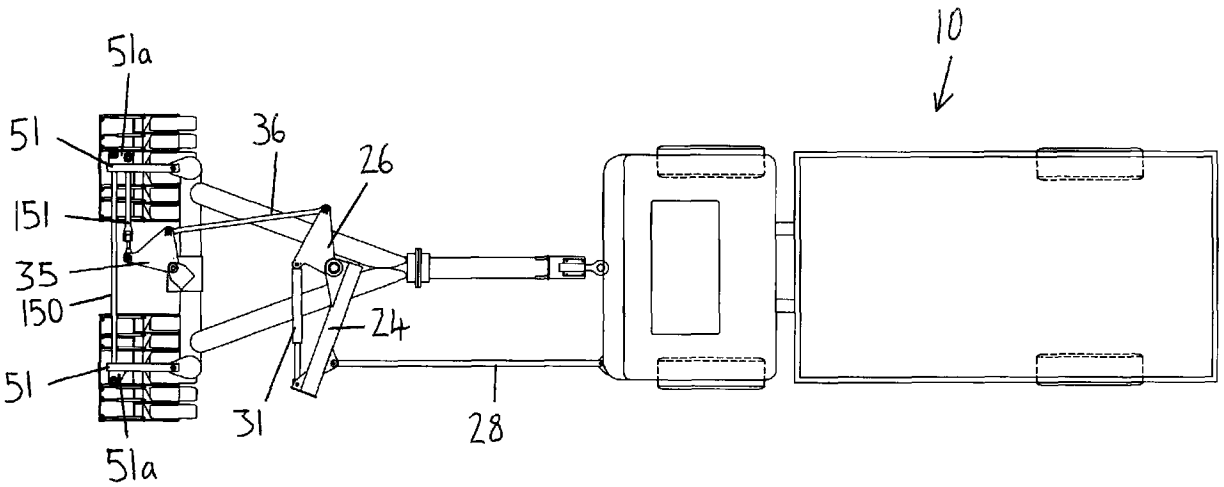
FIG. 27 illustrates a device similar to that shown in FIGS. 2 to 12 with another alternative roller steering linkage mechanism.

FIG. 27 illustrates another embodiment of the apparatus corresponding substantially to that shown in FIGS. 2 to 12. The difference lies in the steering linkage. The arms 51 are connected together by a tie rod 150 and a steering rod 151 extends from the plate 35 and attaches to one of the arms 51. The tie rod 150 attaches to brackets 51*a* extending from the arms 51 and the steering rod 151 attaches to one of the brackets 51*a* and to the plate 35, the respective attachments providing for pivoting between the so attached components.

Figure 28:
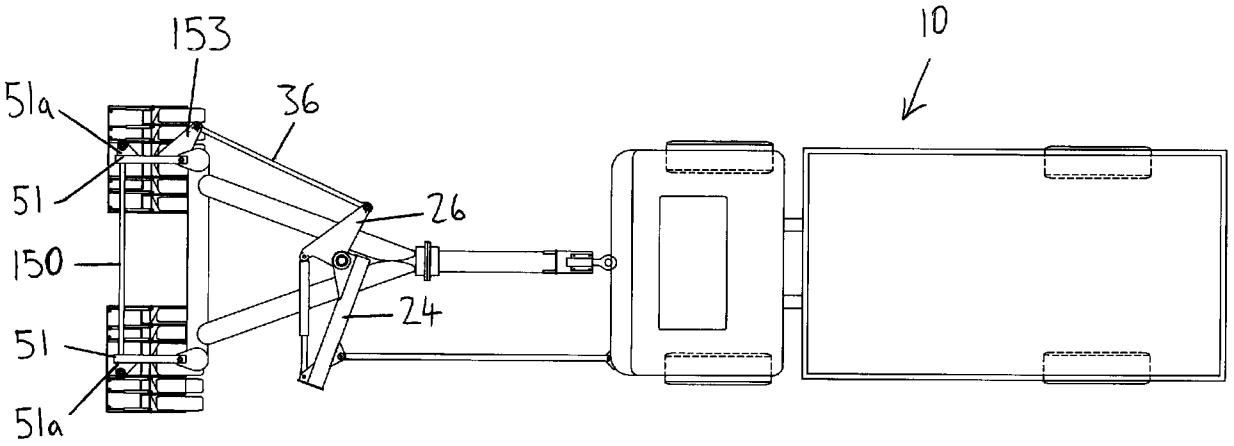
FIG. 28 illustrates a device similar to that shown in FIGS. 2 to 12 with yet another alternative roller steering linkage mechanism.

FIG. 28 illustrates another embodiment of the apparatus corresponding substantially to that shown in FIGS. 2 to 12. The difference lies in the steering linkage. The arms 51 are connected together by a tie rod 150. The plate 35 is omitted and the tie rod 36 is pivotally attached to a bracket 153 that is fixed to the arm 51. Hence, rotation of the bracket 26 causes the arm 51 to which the bracket 153 is attached to rotate and hence by virtue of the tie rod 150 the other arm 51 to also rotate.

Figure 5:
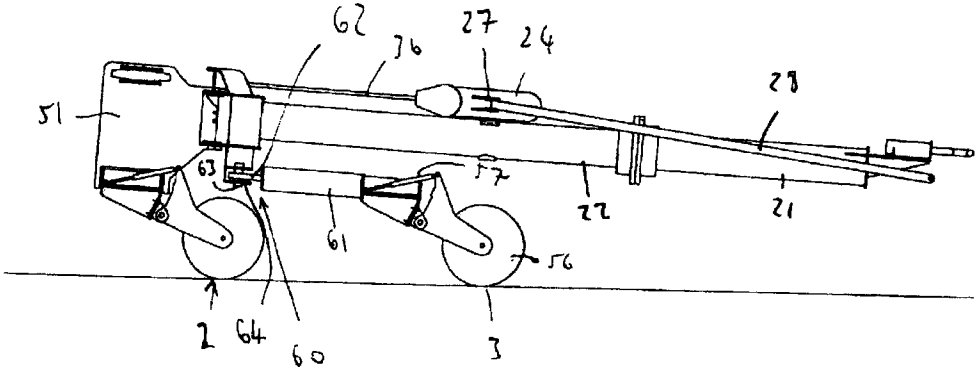
FIG. 5 is a side view of the device illustrated in FIG. 4.
Figure 29:
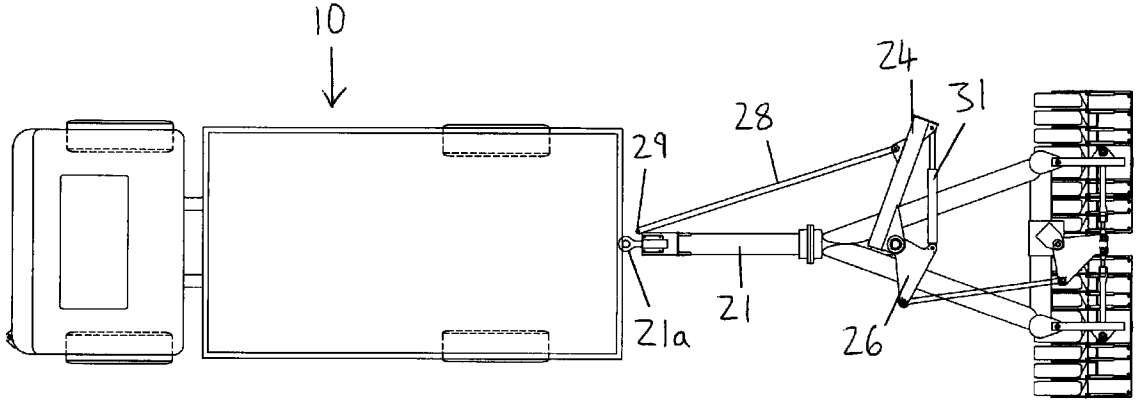
FIG. 29 illustrates a device of the type shown in FIGS. 2 to 12 in a towed configuration.

FIG. 29 illustrates the roller apparatus of the type shown in FIGS. 2 to 12 being towed by a towing vehicle 10, for example for transport between operations. When being towed, the reversing locks described with reference to FIGS. 4 to 6 are engaged, or the end 29 of the link 28 that would attach to the front of the pushing vehicle is attached instead to the push bar 21, or in the case of the embodiments of the apparatus where an electronic feedback system is used, the PLC is set to a "travel" setting where the roller sets 1, 2 are aligned at zero degrees to the direction of travel. In each configuration the arms 51 are locked against rotation.

Figure 30:
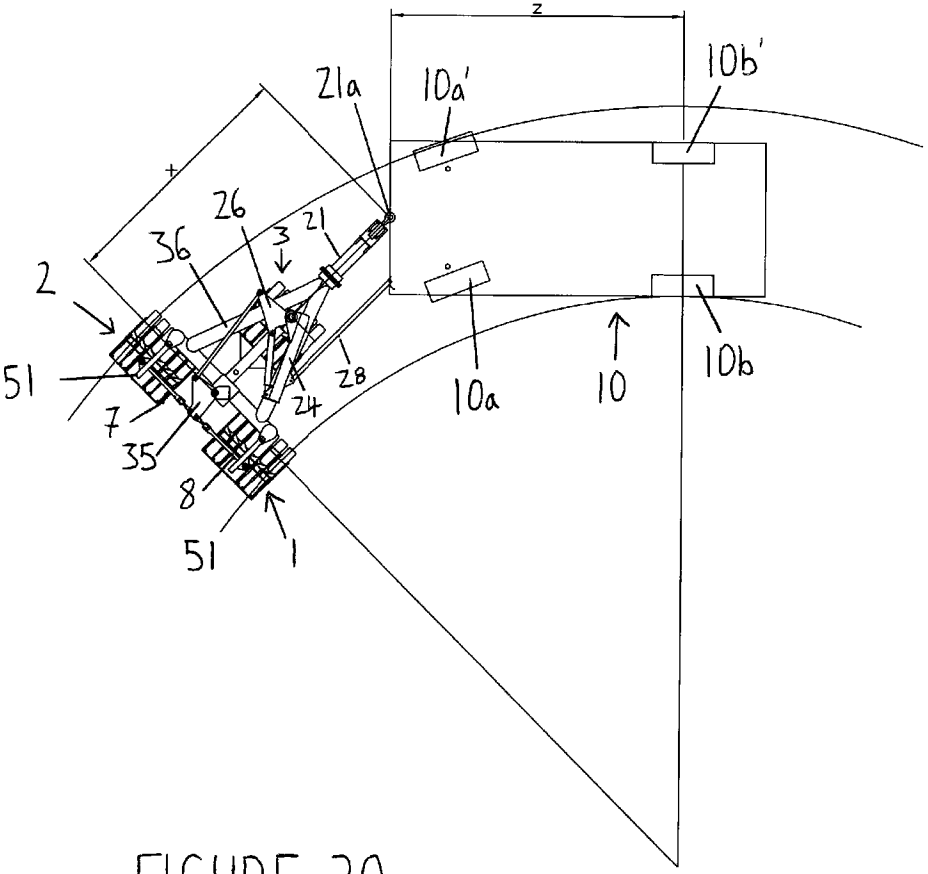
FIG. 30 illustrates the relationship between the stand off distance and the size of the pushing vehicle.
Figure 31A:
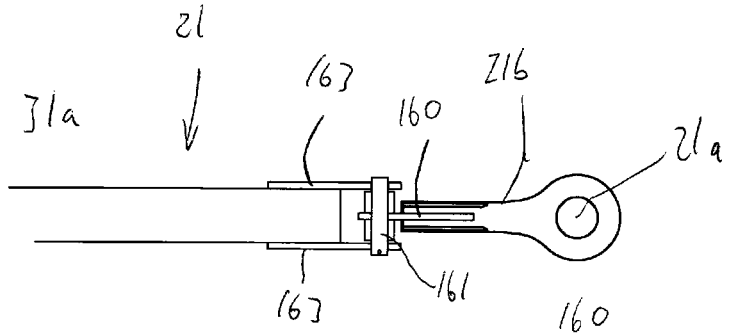
FIGS. 31*a* to 31*c* illustrate a part of the device configured for remote separation thereof from a pushing vehicle.
Figure 31B:
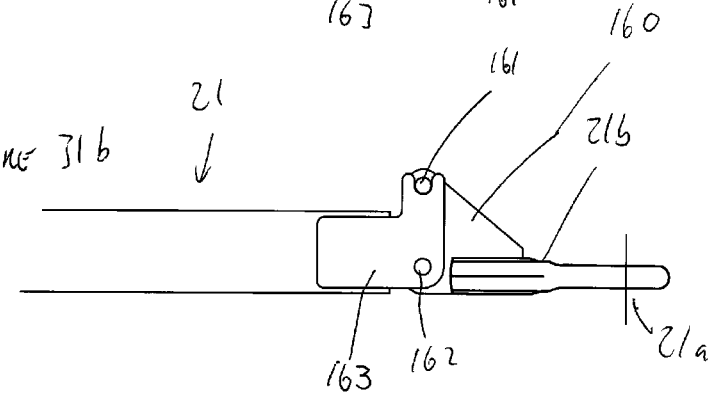
Figure 31C:
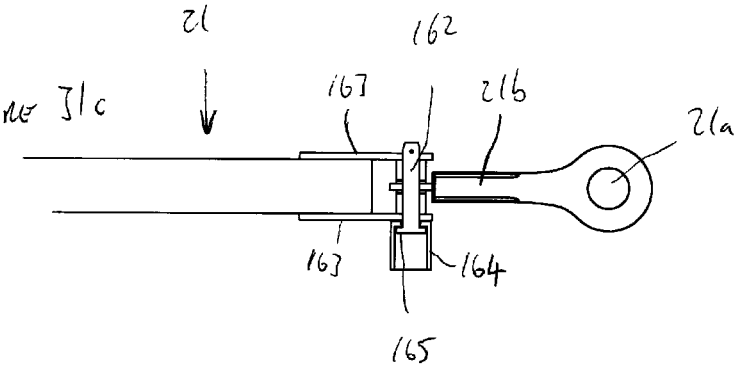

FIG. 30 illustrates the relationship between the stand off distance and the size of the pushing vehicle 10. The stand off distance x provides that mines are engaged by the rollers 1 to 3 at a distance from the cab of the pushing vehicle, and for the roller sets 1, 2 to lie relatively straight when a turn is being executed. This is desirable so that when exiting a turn as much steering actuation as possible is available.

One way of calculating the stand off distance x is to multiply the sum of the wheelbase of the pushing vehicle and the distance between the pintle 9 and the front axle centre line of the pushing vehicle by a stand off multiplier. It is preferable that the stand off multiplier is between 0.4 and 1.6. It is more preferable that the stand off multiplier is between 0.6 and 1.2 and it is most preferable that the stand off multiplier is 0.85.

It is advantageous that the apparatus of the invention may be released rapidly from a pushing vehicle. An arrangement providing for this is described with reference to FIGS. 31*a* to 33*c*.

Referring now to FIGS. 31*a* to 33*c*, the towing eye 21*a* includes a shaft 21*b* that is attached to a plate 160. The plate 160 mounts a pin 161 that extends to both sides of the plate. The pin 161 sits in U shaped brackets 163*a* formed in plates 163, which are attached to the push bar 21. Each plate 163 includes a hole 163*b* which receives a second pin 162. In the configurations shown in FIGS. 31*a* to 31*c*, 32*a* and 33*a* the pin 162 extends through a hole 162*a* in the plate 160 and through holes 163*b* in the plates 163.

Figure 33A:
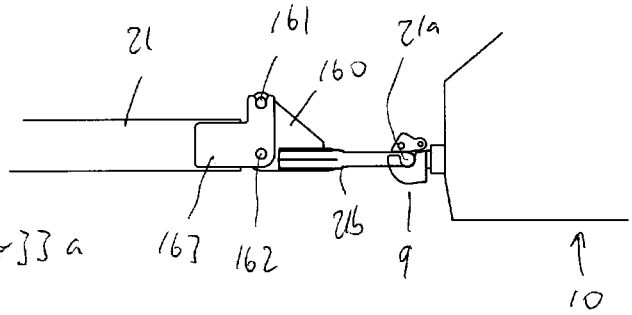
FIGS. 33*a* to 33*c* illustrate the device connected to and separating from the pushing vehicle.
Figure 33B:
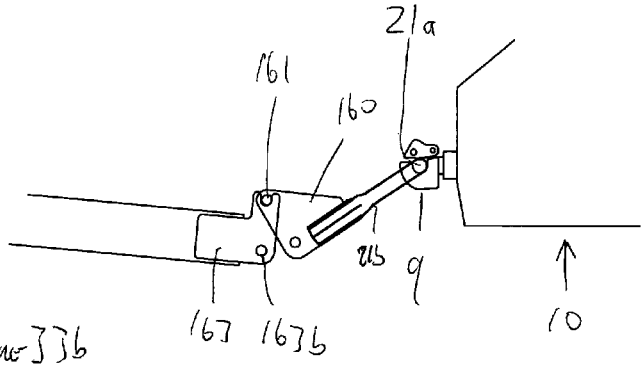
Figure 33C:
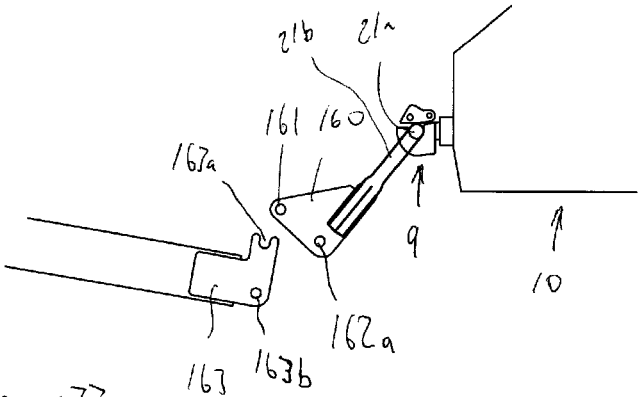

The pin 162 is retractable from the holes 162*a*, 163*b* in order that the plates 163 and hence the major part of the apparatus may release from the towing eye 21*a* as shown in FIGS. 33*a* to 33*c*.

The pin 162 forms part of a hydraulically operated piston and cylinder arrangement. The cylinder 164 is attached to one of the plates 163. The pin 162 mounts a piston head 165 which is slidably mounted within the cylinder 164.

The pin 162 includes a hole 162*b*. When the pin 162 is inserted through the holes 162*a*, 163*a* a split pin is passed through the hole 162*b* to hold the pin 162 in place.

Figure 32A:
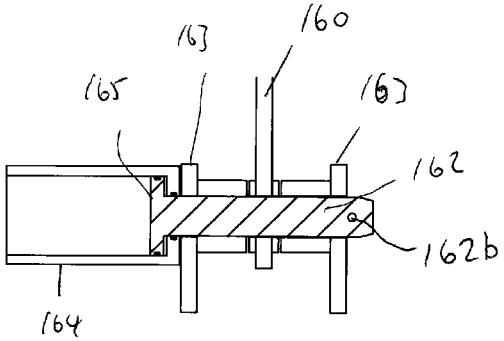
FIGS. 32*a* to 32*c* illustrate in detail components of the arrangement shown in FIGS. 31*a* to 31*c*.
Figure 32B:
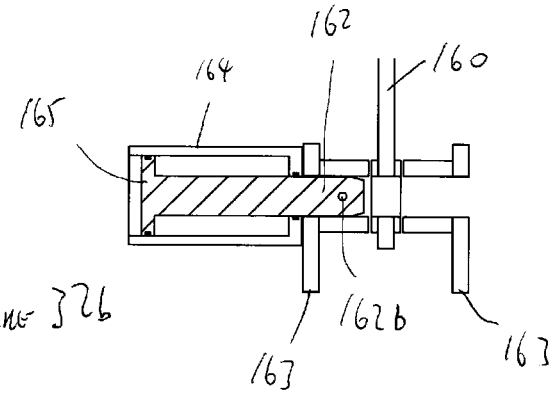
Figure 32C:
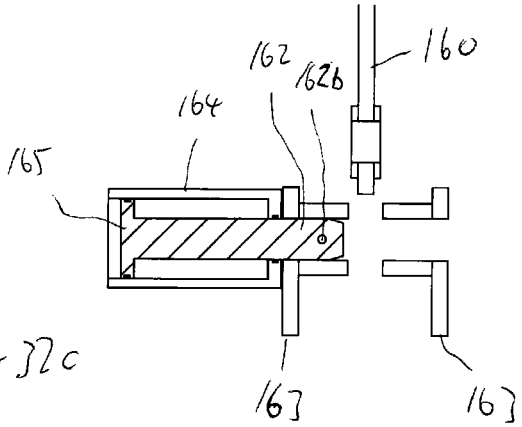

The apparatus may be jettisoned by introducing hydraulic fluid into the cylinder 164 to push the piston head 165 and hence pin 162 from the position shown in FIG. 32*a* to the position shown in FIGS. 32*b* and 32*c*. When so positioned the apparatus moves from the position shown in FIG. 33*a* first to that shown in FIG. 33*b* and then to the position shown in FIG. 33*c*, that is detached from the pushing vehicle.

The towing eye 21*a* remains attached to the pintle 9.

A source of pressurised fluid may comprise a hydraulic accumulator that is configured to introduce hydraulic fluid into the cylinder 164 upon opening of a valve, such as a solenoid operated check valve.

Where a mechanical feedback system is used, the attachment thereof to the pushing vehicle may require a similar arrangement to that shown in FIGS. 31*a* to 33*c*.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. Further, features described with reference to one embodiment are not limited to that particular embodiment but may be used in other embodiments falling within the scope of the claims.

The invention claimed is:

1. A steerable mine detonation roller apparatus adapted to be coupled to and uncoupled from a steered pushing vehicle, the steered pushing vehicle supported on pushing vehicle support members, each pushing vehicle support member configured to traverse a path, said steered pushing vehicle being steerable such that each pushing vehicle support member follows a turning radius, wherein the roller apparatus comprises coupling means for coupling the roller apparatus to and uncoupling the roller apparatus from the steered pushing vehicle, a frame and at least two spaced apart ground engaging members adapted to support the roller apparatus and adapted to exert a force on mines situated in the path of the roller apparatus, the force sufficient to cause detonation of such mines, the at least two spaced apart ground engaging members each pivotally attached to the frame so as to pivot with respect to the frame about respective spaced apart substantially vertical axes, and wherein at least one of the at least two spaced apart ground engaging members is steerable with respect to the frame, the apparatus further comprising a sensor for mounting on the pushing vehicle to sense a parameter related to the turning radius of the steered pushing vehicle, and a steering mechanism operatively connected to the at least one steerable ground engaging member, the steering mechanism including an actuator that varies the configuration of the steering mechanism, and a control system including a controller configured to receive from the sensor an input signal related to the turning radius of the steered pushing vehicle, to generate an actuator control signal related to the input signal from the sensor, and to control the actuator according to the actuator control signal, wherein the so controlled actuator configures the steering mechanism to pivot the at least one steerable ground engaging member with respect to the frame so as to steer the apparatus to follow a detonation path which provides that, in use, the path traversed by all pushing vehicle support members has been traversed by the ground engaging members of the roller apparatus and wherein a turning radius of at least a part of an innermost of the at least two spaced apart ground engaging members of the roller apparatus is less than the turning radius of an innermost of the pushing vehicle support members, and a turning radius of at least a part of an outermost of the at least two spaced apart ground engaging members of the roller apparatus is greater than the a turning radius of an outermost of the pushing vehicle support members.

2. The apparatus according to claim 1, wherein a plurality of the at least two spaced apart ground engaging members are steerable.

3. The apparatus according to claim 1, wherein the actuator is selected from the group comprising a fluid operated ram, a fluid operated motor, an electrically operated ram, an electrically operated motor, and a motor and gearbox assembly.

4. The apparatus according to claim 1, wherein the steering mechanism includes a feedback system adapted to measure deviation of the apparatus from the detonation path, generate a feedback signal and to adjust the steering linkage according to the feedback signal to return the apparatus to said detonation path.

5. The apparatus according to claim 4, wherein the feedback signal is generated mechanically.

6. The apparatus according to claim 4, wherein the feedback signal is generated electronically.

7. The apparatus according to claim 6, further comprising a sensor configured to sense an actual angular position of the apparatus relative to the pushing vehicle.

8. The apparatus according to claim 1, further comprising a steering linkage and wherein the steering linkage is connected to the at least one steerable ground engaging member and the steering mechanism, the actuator configuring the steering mechanism to adjust the steering linkage.

9. The apparatus according to claim 8, wherein the steering mechanism comprises the actuator attached at one end to the steering linkage and the other to the frame.

10. The apparatus according to claim 8, wherein the steering linkage includes a connector rotatably mounted on the frame and operatively connected to the or each steerable ground engaging member, and wherein the steering mechanism is operatively attached to the connector.

11. The apparatus according to claim 1, the steering mechanism further comprising at least one member arranged to pivot about a substantially vertical pivot axis.

12. The apparatus according to claim 11, comprising first and second members each arranged to rotate about substantially vertical pivot axes, wherein the actuator is adapted to adjust the relative position of the first member with respect to the second member.

13. The apparatus according to claim 12, wherein the first and second members are mounted to rotate about the same substantially vertical axis independently of each other.

14. The apparatus according to claim 12, further comprising a steering linkage and wherein the steering linkage is connected to the at least one steerable ground engaging member and the steering mechanism, the actuator configuring the steering mechanism to adjust the steering linkage wherein one of the first and second members is operatively connected to the steering linkage.

15. The apparatus according to claim 14, wherein the steering mechanism includes a tie member having two ends, the tie member being pivotably attached at one of its ends to one of the first and second members and operatively attached to the steering linkage at its other end.

16. The apparatus according to claim 14, wherein the steering mechanism includes a tie member having two ends, the tie member being pivotably attached at one of its ends to the other of the first and second members at its other end to a pushing vehicle.

17. The apparatus according to claim 12, further comprising a steering linkage and wherein the steering linkage is connected to the at least one steerable ground engaging member and the steering mechanism, the actuator configuring the steering mechanism to adjust the steering linkage wherein one of the first and second members is operatively connected to the steering linkage and the other of the first and second members is operatively connected to the pushing vehicle.

18. The apparatus according to claim 1, wherein the at least two spaced apart ground engaging members and the coupling means are separated from each other by a stand-off distance.

19. The apparatus according to claim 1, wherein at least one ground engaging member is adapted to follow the path of the apparatus set by the at least one steerable ground engaging member.

20. The apparatus according to claim 1, further including a steering lock providing locked and unlocked configurations of the at least one steerable ground engaging member.

21. The apparatus according to claim 20, wherein the steering lock includes at least one element movable between a locked configuration in which said element engages with a part of the steerable ground engaging member and an unlocked configuration in which the said element is disengaged from the steerable ground engaging member.

22. The apparatus according to claim 20, wherein the actuator is provided with a float setting in which the actuator configuration changes according to passive forces exerted thereon.

23. The apparatus according to claim 1, wherein the at least two ground engaging members are mounted to pivot about a substantially horizontal axis.

24. The apparatus according to claim 1, wherein each steerable ground engaging member includes a plurality of individual ground engaging elements, each element being mounted to move independently in a substantially vertical plane.

25. The combination of a steered pushing vehicle and coupled thereto a steerable mine detonation roller apparatus adapted to be coupled to and uncoupled from a steered pushing vehicle, the steered pushing vehicle supported on pushing vehicle support members, each pushing vehicle support member configured to traverse a path, said steered pushing vehicle being steerable such that each pushing vehicle support member follows a turning radius, wherein the roller apparatus comprises coupling means for coupling the roller apparatus to and uncoupling the roller apparatus from the steered pushing vehicle, a frame and at least two spaced apart ground engaging members adapted to support the roller apparatus and adapted to exert a force on mines situated in the path of the roller apparatus, the force sufficient to cause detonation of such mines, the at least two spaced apart ground engaging members each pivotally attached to the frame so as to pivot with respect to the frame about respectively spaced apart substantially vertical axes, and wherein at least one of the at least two spaced apart ground engaging member is steerable with respect to the frame, the roller apparatus further comprising a sensor for mounting on the pushing vehicle to sense a parameter related to the turning radius of the steered pushing vehicle, and a steering mechanism operatively connected to the at least one steerable ground engaging member, the steering mechanism including an actuator that varies the configuration of the steering mechanism, and a control system including a controller configured to receive from the sensor an input signal related to the turning radius of the steered pushing vehicle and to generate an actuator control signal related to the input signal from the sensor, and to control the actuator according to the actuator control signal, wherein the so controlled actuator configures the steering mechanism to pivot the at least one steerable ground engaging member with respect to the frame so as to steer the apparatus to follow a detonation path which provides that, in use, the path traversed by all pushing vehicle support members has been traversed by the ground engaging members of the roller apparatus and wherein a turning radius of at least a part of an innermost of the at least two spaced apart ground engaging members is less than the turning radius of an innermost of the pushing vehicle support members, and a turning radius of at least a part of an outermost of the at least two spaced apart ground engaging members is greater than the turning radius of an outermost of the pushing vehicle support members.

* * * * *